US008556251B2

(12) United States Patent
Fujita et al.

(10) Patent No.: US 8,556,251 B2
(45) Date of Patent: Oct. 15, 2013

(54) PAPER SHEET HANDLING MACHINE WITH MOVING PLATES AND CONVEYOR ASSEMBLIES

(75) Inventors: Junji Fujita, Nagoya (JP); Masanori Terao, Owariasahi (JP); Shinya Miwa, Owariasahi (JP); Riichi Kato, Nagoya (JP); Minoru Kadowaki, Toyota (JP); Shinji Shibata, Nagoya (JP); Youta Sasajima, Owariasahi (JP)

(73) Assignee: Hitachi Omron Terminal Solutions, Corp., Tokyo (JP)

( * ) Notice: Subject to any disclaimer, the term of this patent is extended or adjusted under 35 U.S.C. 154(b) by 213 days.

(21) Appl. No.: 12/690,276

(22) Filed: Jan. 20, 2010

(65) Prior Publication Data

US 2010/0213660 A1 Aug. 26, 2010

(30) Foreign Application Priority Data

Feb. 25, 2009 (JP) ..... 2009-041584
Feb. 25, 2009 (JP) ..... 2009-041788
Feb. 25, 2009 (JP) ..... 2009-041789

(51) Int. Cl.
*B65H 5/12* (2006.01)

(52) U.S. Cl.
CPC ..... *B65H 5/12* (2013.01)
USPC ..... 271/3.15; 198/589; 414/790.7

(58) Field of Classification Search
USPC ..... 271/3.15; 198/589, 861.3; 414/789.9, 414/790.6, 790.7
See application file for complete search history.

(56) References Cited

U.S. PATENT DOCUMENTS 6,244,583 B1 * 6/2001 Ohmichi et al. ..... 270/58.07
2005/0127590 A1 6/2005 Ugo et al.
2007/0007707 A1 1/2007 Abe et al.
2008/0142583 A1 * 6/2008 Yokoi et al. ..... 235/379
2009/0033020 A1 2/2009 Leeper
2009/0118861 A1 * 5/2009 Kanagawa et al. ..... 700/231

FOREIGN PATENT DOCUMENTS

| | | |
|---|---|---|
| EP | 0 793 197 | 9/1997 |
| EP | 1 315 127 | 5/2003 |
| EP | 1 926 057 | 5/2008 |
| EP | 2 058 775 | 5/2009 |
| GB | 2 123 592 | 2/1984 |
| JP | 03-192049 | 8/1991 |
| JP | 2002-329229 | 11/2002 |
| JP | 2005-259086 | 9/2005 |

OTHER PUBLICATIONS

European Search Report dated Apr. 13, 2011 for Application No. EP 10 19 4957.

* cited by examiner

*Primary Examiner* — Gerald McClain
(74) *Attorney, Agent, or Firm* — Antonelli, Terry, Stout & Kraus, LLP.

(57) ABSTRACT

A paper sheet handling machine is provided, including: a paper sheet slot configured to receive and provide a paper sheet, a pair of push plates configured to hold the paper sheet inserted into and discharged from the paper sheet handling machine via the paper sheet slot and apply a pressing force to the paper sheet in a thickness direction thereof, pair of conveyor assemblies including a first conveyor assembly and a second conveyor assembly configured to hold and convey the paper sheet inserted and discharged via the paper sheet slot; and a moving mechanism configured to move the first conveyor assembly and the second conveyor assembly in mutually approaching directions or in mutually away directions, and to locate the first conveyor assembly and the second conveyor assembly at any position in between and external to the pair of push plates, as seen from the paper sheet slot.

11 Claims, 22 Drawing Sheets

<AT THE TIME OF CASH DEPOSIT TRANSACTION>

SECOND EMBODIMENT

<AT THE TIME OF CASH DEPOSIT TRANSACTION>

[SUCCESSFUL CONVEYANCE OF BUNDLE OF BILLS]

[FAILED CONVEYANCE OF BUNDLE OF BILLS]

MODIFIED EXAMPLE 1

[AT THE TIME OF INSERTION OF BILLS]

[AT THE TIME OF FEEDING BILLS]

MODIFIED EXAMPLE 2

PAPER SHEET HANDLING MACHINE WITH MOVING PLATES AND CONVEYOR ASSEMBLIES

CROSS-REFERENCE TO RELATED APPLICATIONS

The present application claims the priority based on Japanese Patent Applications No. 2009-41584 filed on Feb. 25, 2009; No. 2009-41788 filed on Feb. 25, 2009; and No. 2009-41789 filed on Feb. 25, 2009, the disclosures of which are hereby incorporated by reference in their entireties.

BACKGROUND OF THE INVENTION

1. Field of the Invention

The present invention relates to a technique of conveying paper sheets in a paper sheet handling machine.

2. Description of the Related Art

One typical example of paper sheet handling machines for handling paper sheets, such as banknotes or bills and business forms, is an automated teller machine used in financial facilities. One proposed internal structure of the automated teller machine inside a cash slot has plate members (push plates) arranged to apply a pressing force onto bills and conveyor belts for conveyance of bills arranged in parallel with the push plates (see Japanese Patent Laid-Open No. H03-192049). The automated teller machine of this prior art structure uses the conveyor belts to automatically draw in bills inserted into the cash slot at the time of a cash deposit transaction and to automatically discharge bills from the cash slot at the time of a cash withdrawal transaction. The user can thus insert and take out the bills without inserting the hand or fingers.

In the automated teller machine of the prior art structure, however, the bill may be bent or folded inside the cash slot, due to the positional relation between the conveyor belts and the push plates. There may be accordingly a bill jam in the course of feeding the inserted bills into the automated teller machine. For example, when there is a difference in level between the location of the conveyor belts and the location of the push plates relative to the inserted bills, the level difference bends the bills and feeds the bills in the bent state inside the machine. This may cause a bill jam. Similarly a bill jam may occur when the user inserts bills in a misaligned state or when the user inserts a large bundle of bills. Such a bill jam may also occur in the case of delivery of bills. This problem is not characteristic of the automated teller machine but is commonly found in any types of other paper sheet handling machines.

SUMMARY

An object of the present invention is to provide technology that is able to prevent the occurrence of a paper sheet jam during conveyance of a paper sheet in a paper sheet handling machine, while enabling the user to readily insert and take out the paper sheet into and from the paper sheet handling machine without inserting the hand or fingers.

According to an aspect of the present invention, a paper sheet handling machine is provided. The paper sheet handling machine comprises: a paper sheet slot configured to provide and deliver a paper sheet; a pair of push plates configured to hold the paper sheet inserted into and discharged from the paper sheet handling machine via the paper sheet slot and apply a pressing force to the paper sheet in a thickness direction thereof; a pair of conveyor assemblies including a first conveyor assembly and a second conveyor assembly configured to hold and convey the paper sheet inserted and discharged via the paper sheet slot; and a moving mechanism configured to move the first conveyor assembly and the second conveyor assembly in mutually approaching directions or in mutually away directions and locate the first conveyor assembly and the second conveyor assembly at any position between inside and outside the pair of push plates, seen from the paper sheet slot.

According to this configuration, in the paper sheet handling machine according to this aspect of the invention, the first conveyor assembly and the second conveyor assembly are moved either in the mutually approaching direction or in the mutually away direction to be located at any position between inside and outside the pair of push plates, seen from the paper sheet slot. At the time of insertion of the paper sheet, positioning the first conveyor assembly and the second conveyor assembly inside the pair of push plates, seen from the paper sheet slot, enables the paper sheet to be securely held and conveyed into the paper sheet handling machine. This arrangement enables the user to readily insert the paper sheet into the paper sheet handling machine without inserting the hand or fingers. After the insertion of the paper sheet, positioning the first conveyor assembly and the second conveyor assembly outside the pair of push plates, seen from the paper sheet slot, enables the inserted paper sheet to be securely held by the pair of push plates and thus effectively prevents the paper sheet from being bent or folded in the course of being fed into the paper sheet handling machine. In the paper sheet handling machine of the present invention, the first conveyor assembly and the second conveyor assembly may be located at any position between inside and outside the pair of push plates, seen from the paper sheet slot. In some nations and countries where many users may be afraid of inserting their hands or fingers inside the machine, at the time of insertion of the paper sheet, the work mode of the paper sheet handling machine may be set to locate the first conveyor assembly and the second conveyor assembly inside the pair of push plates. In other nations and countries where few users may be afraid of inserting their hands or fingers inside the machine, the work mode of the paper sheet handling machine may be set to locate the first conveyor assembly and the second conveyor assembly outside the pair of push plates.

In one preferable application of the paper sheet handling machine according to the above aspect of the invention, the pair of push plates and the pair of conveyor assemblies are arranged to be overlapped with each other in a specific state where a distance between the pair of push plates is identical with a distance between the pair of conveyor assemblies.

This structure desirably shortens the dimension of the paper sheet handling machine in the insertion/discharge directions of the paper sheet, compared with a structure where the pair of push plates have no overlapping arrangement with the pair of conveyor assemblies, thus attaining size reduction of the whole paper sheet handling machine.

In another preferable application of the paper sheet handling machine according to the above aspect of the invention, the pair of conveyor assemblies are configured to hold a central part of the paper sheet in a width direction thereof.

In the paper sheet handling machine of this application, both end parts of the paper sheet in the width direction are not in contact with the pair of conveyor assemblies but are located in a relatively wide space. When the user holds a central part of a bundle of paper sheets to insert or take out the bundle of paper sheets into or from the paper sheet handling machine, the bundle of paper sheets having a large thickness may have spread ends. Even in such cases, this arrangement causes the spread ends of the bundle of paper sheets to be received in a relatively wide space, thus assuring the user's easy insertion of the bundle of paper sheets into the paper sheet handling machine.

In still another preferable application of the paper sheet handling machine according to the above aspect of the invention, at least either of the pair of conveyor assemblies and the pair of push plates hold the paper sheet to be arranged along a vertical direction.

When holding a bundle of paper sheets, the paper sheet handling machine of this application enables any foreign substance, such as a coin, that is present between adjacent paper sheets to be fallen down and removed by means of the gravity. The paper sheets are held to be arranged along the vertical direction. The lower ends of the paper sheets may thus be pressed against an arbitrary plane (for example, a bottom plate) to be readily aligned.

In one preferable embodiment of the invention, the paper sheet handling machine of the above aspect further comprises: a first sensor configured to detect insertion of the paper sheet into the paper sheet slot; and a second sensor configured to detect arrangement of the paper sheet at a holdable position to be held by the pair of push plates. The moving mechanism moves the first conveyor assembly and the second conveyor assembly to be located inside the pair of push plates, seen from the paper sheet slot, prior to insertion of the paper sheet into the paper sheet slot. When the first sensor detects the insertion of the paper sheet into the paper sheet slot, the first conveyor assembly and the second conveyor assembly hold the paper sheet and convey the paper sheet in a receiving direction to be taken into the paper sheet handling machine. When the second sensor detects the arrangement of the paper sheet at the holdable position to be held by the pair of push plates, the moving mechanism moves the first conveyor assembly and the second conveyor assembly to be located outside the pair of push plates, seen from the paper sheet slot.

The structure of this embodiment causes the inserted paper sheet to be securely held by the pair of conveyor assemblies and conveyed into the paper sheet handling machine. This gives the user the paper sheet draw-in feeling and enables the user to readily insert the paper sheet into the paper sheet handling machine without inserting the hand or fingers. When the paper sheet is arranged at the holdable position to be held by the pair of push plates, the pair of conveyor assemblies are moved to be located outside the pair of push plates. This arrangement causes the paper sheet to be not in contact with the pair of conveyor assemblies, thus effectively preventing the paper sheet from being bent or folded.

In another preferable embodiment of the invention, the paper sheet handling machine of the above aspect further comprises: a third sensor configured to detect arrangement of the paper sheet at a holdable position to be held by the pair of conveyor assemblies. The moving mechanism moves the first conveyor assembly and the second conveyor assembly to be located outside the pair of push plates, seen from the paper sheet slot, prior to discharge of the paper sheet from the paper sheet slot. When the third sensor detects the arrangement of the paper sheet at the holdable position to be held by the pair of conveyor assemblies, the moving mechanism moves the first conveyor assembly and the second conveyor assembly to be located inside the pair of push plates, seen from the paper sheet slot. When the third sensor detects the arrangement of the paper sheet at the holdable position to be held by the pair of conveyor assemblies, the first conveyor assembly and the second conveyor assembly hold the paper sheet and convey the paper sheet in a delivery direction toward the paper sheet slot.

The structure of this embodiment causes the paper sheet to be securely held by the pair of conveyor assemblies and conveyed toward the paper sheet slot. This enables the user to simply pull and take out the paper sheet discharged from the paper sheet slot without inserting the hand or fingers. Until the paper sheet is arranged at the holdable position to be held by the pair of push plates, the pair of conveyor assemblies are kept outside the pair of push plates. This arrangement causes the paper sheet to be not in contact with the pair of conveyor assemblies in the course of the arrangement at the holdable position to be held by the pair of conveyor assemblies, thus effectively preventing the paper sheet from being bent or folded.

In another preferable application of the paper sheet handling machine according to the above aspect of the invention, each of the first conveyor assembly and the second conveyor assembly has multiple belts arranged in parallel with a direction of conveyance of the paper sheet.

In the paper sheet handling machine of this application, the paper sheet is conveyed while being supported by the multiple belts. This arrangement desirably prevents the paper sheet from being folded or bent in the course of conveyance.

In still another preferable embodiment of the invention, the paper sheet handling machine of the above aspect further comprises: a driving source configured to generate a conveyance driving force of the paper sheet to be used by the first conveyor assembly; a frame configured to support the first conveyor assembly to be movable in either a direction approaching to the second conveyor assembly or a direction away from the second conveyor assembly; and a transmission structure coupled with the first conveyor assembly to move with a motion of the first conveyor assembly and transmit the conveyance driving force generated by the driving source to the first conveyor assembly.

This arrangement does not require the motion of the driving source accompanied with the first conveyor assembly, thus assuring the relatively simple structure of the paper sheet handling machine.

According to another aspect, the invention is also directed to a method of receiving a paper sheet in a paper sheet handling machine. The paper sheet handling machine includes: a paper sheet slot configured to receive and provide a paper sheet; a pair of push plates configured to hold the paper sheet inserted into and discharged from the paper sheet handling machine via the paper sheet slot and apply a pressing force to the paper sheet in a thickness direction thereof; a pair of conveyor assemblies including a first conveyor assembly and a second conveyor assembly configured to hold and convey the paper sheet inserted and discharged via the paper sheet slot; a first sensor configured to detect insertion of the paper sheet into the paper sheet slot; and a second sensor configured to detect arrangement of the paper sheet at a holdable position to be held by the pair of push plates.

The method moves the first conveyor assembly and the second conveyor assembly in mutually approaching directions to be located inside the pair of push plates, seen from the paper sheet slot. When the first sensor detects the insertion of the paper sheet into the paper sheet slot, the paper receiving method causes the first conveyor assembly and the second conveyor assembly to hold the paper sheet and take in the paper sheet in a receiving direction to be taken into the paper sheet handling machine. When the second sensor detects the arrangement of the paper sheet at the holdable position to be held by the pair of push plates, the paper receiving method moves the first conveyor assembly and the second conveyor assembly to be located outside the pair of push plates, seen from the paper sheet slot.

The method of receiving a paper sheet according to this aspect of the invention causes the inserted paper sheet to be securely held by the pair of conveyor assemblies and conveyed into the paper sheet handling machine. This gives the user the paper sheet draw-in feeling and enables the user to readily insert the paper sheet into the paper sheet handling machine without inserting the hand or fingers. When the paper sheet is arranged at the holdable position to be held by the pair of push plates, the pair of conveyor assemblies are moved to be located outside the pair of push plates. This method causes the paper sheet to be not in contact with the pair of conveyor assemblies, thus effectively preventing the paper sheet from being bent or folded.

According to still another aspect, the invention is further directed to a method of delivering a paper sheet in a paper sheet handling machine. The paper sheet handling machine includes: a paper sheet slot configured to receive and provide a paper sheet; a pair of push plates configured to hold the paper sheet inserted into and discharged from the paper sheet handling machine via the paper sheet slot and apply a pressing force to the paper sheet in a thickness direction thereof; a pair of conveyor assemblies including a first conveyor assembly and a second conveyor assembly configured to hold and convey the paper sheet inserted and discharged via the paper sheet slot; and a third sensor configured to detect arrangement of the paper sheet at a holdable position to be held by the pair of conveyor assemblies.

The method moves the first conveyor assembly and the second conveyor assembly to be located outside the pair of push plates, seen from the paper sheet slot. When the third sensor detects the arrangement of the paper sheet at the holdable position to be held by the pair of conveyor assemblies, moving the first conveyor assembly and the second conveyor assembly to be located inside the pair of push plates, seen from the paper sheet slot. When the third sensor detects the arrangement of the paper sheet at the holdable position to be held by the pair of conveyor assemblies, causing the first conveyor assembly and the second conveyor assembly to hold the paper sheet and convey the paper sheet in a delivery direction toward the paper sheet slot.

The method of delivering a paper sheet according to this aspect of the invention causes the paper sheet to be securely held by the pair of conveyor assemblies and conveyed toward the paper sheet slot. This enables the user to simply pull and take out the paper sheet discharged from the paper sheet slot without inserting the hand or fingers. Until the paper sheet is arranged at the holdable position to be held by the pair of push plates, the pair of conveyor assemblies are kept outside the pair of push plates. This method causes the paper sheet to be not in contact with the pair of conveyor assemblies in the course of the arrangement at the holdable position to be held by the pair of conveyor assemblies, thus effectively preventing the paper sheet from being bent or folded.

DESCRIPTION OF THE PREFERRED EMBODIMENT

Next, aspects of the present invention will be described in the following order on the basis of embodiments:

A. First Embodiment

A1. System Configuration

Figure 1:
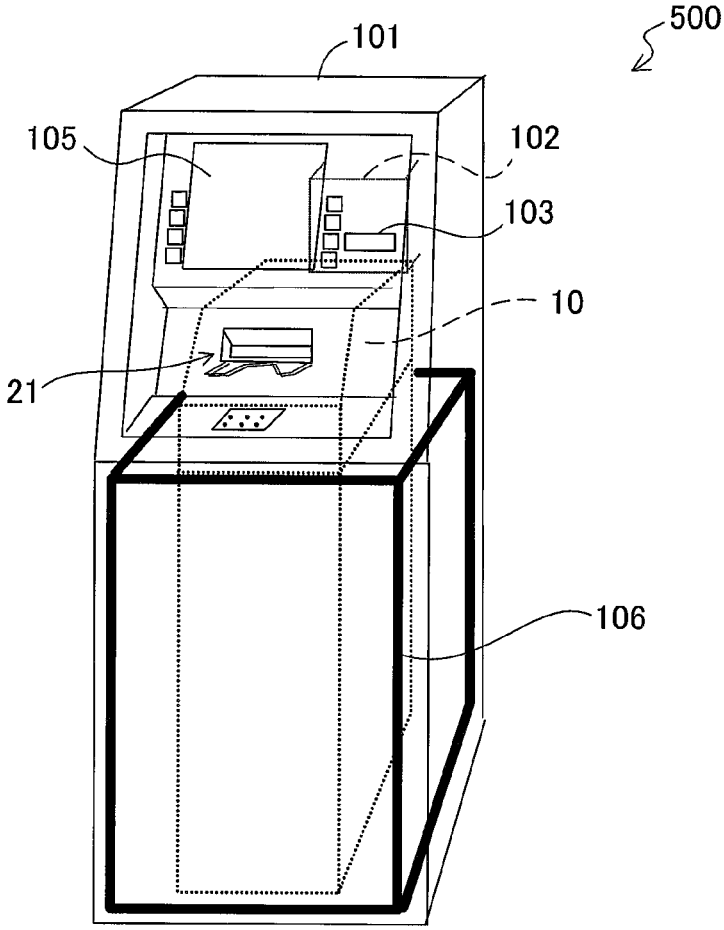
FIG. 1 is an explanatory diagram illustrating the schematic configuration of an automated teller machine as one embodiment of the paper sheet handling machine in accordance with the present invention.

FIG. 1 is an explanatory diagram illustrating the schematic configuration of an automated teller machine 500 as one embodiment of the paper sheet handling machine in accordance with the present invention. The automated teller machine 500 is designed to perform various financial transactions including deposits and withdrawals of cash (banknotes or bills) and money transfers.

The automated teller machine 500 includes a cash handling system 10, a vault casing 106, and a card/receipt processing mechanism 102 located inside a housing 101. The automated teller machine 500 has a card slot 103, a customer operation unit 105, and a cash slot 21 provided in a front face of the housing 101.

The cash handling system 10 receives and provides bills. The cash handling system 10 has a bill storage mechanism (not shown) provided in a lower portion thereof to be located inside the vault casing 106. The vault casing 106 is made of a thick metal plate (for example, an iron plate of about 50 millimeters in thickness). The card/receipt processing mechanism 102 is connected with the card slot 103 to process the user's cash card inserted through the card slot 103 and print and issue a relevant transaction receipt. The card slot 103 is provided to receive the cash card inserted by the user and return the cash card to the user. The customer operation unit 105 has a touch-panel display to show menus of various financial transactions. The cash slot 21 is provided to receive bills from the user and provide bills to the user.

Figure 2:
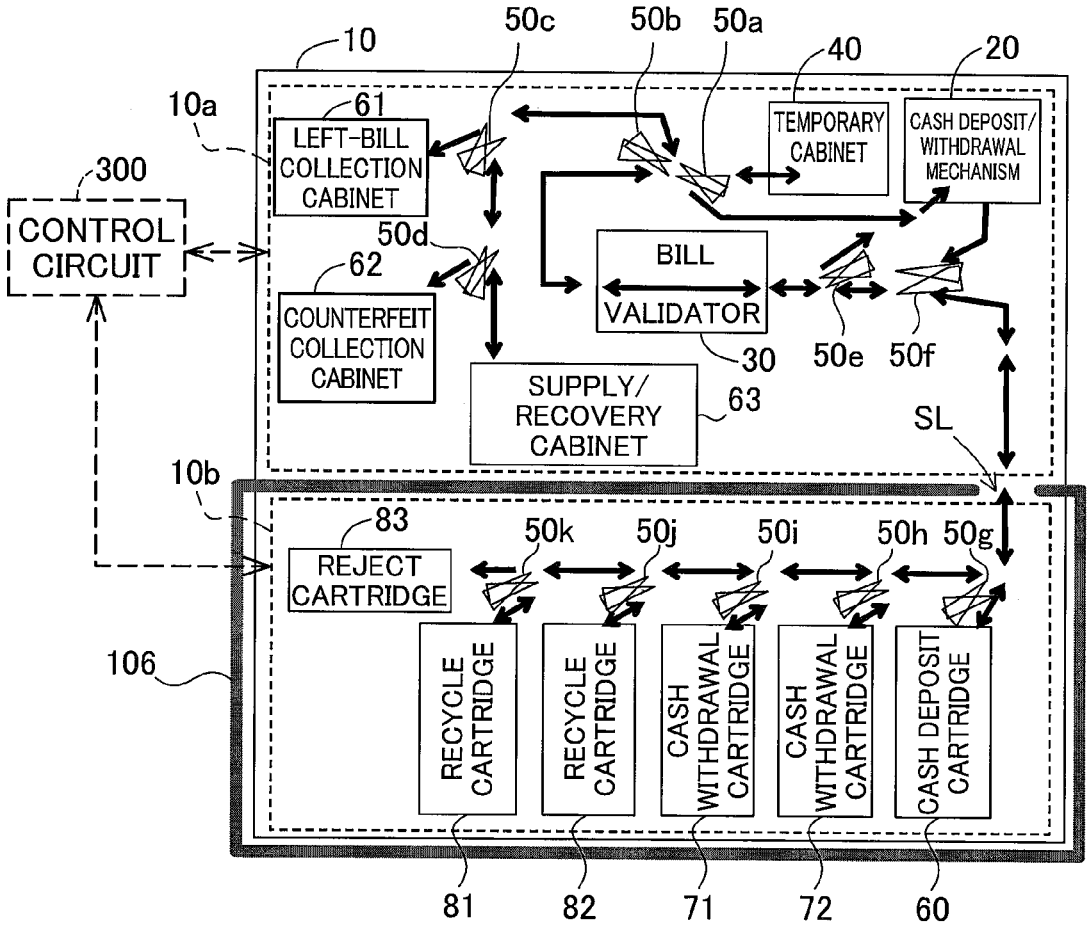
FIG. 2 is an explanatory diagram showing the detailed structure of the cash handling system shown in FIG. 1.

FIG. 2 is an explanatory diagram showing the detailed structure of the cash handling system 10 shown in FIG. 1. The cash handling system 10 has an upper conveyance mechanism 10*a* and a lower conveyance mechanism 10*b*. The upper conveyance mechanism 10*a* includes a cash deposit/withdrawal mechanism 20, a bill validator 30, a temporary cabinet 40, a left-bill collection cabinet 61, a counterfeit collection cabinet 62, a supply/recovery cabinet 63, six switchover gates 50*a* through 50*f*, and a bill conveyor path (shown by arrows).

The cash deposit/withdrawal mechanism 20 receives bills inserted by the user via the cash slot 21 (FIG. 1) into the automatic teller machine 500 and provides bills via the cash slot 21 to the user. The bill validator 30 classifies the bills by the denominations and checks for the authenticity of the bills. The temporary cabinet 40 is used to temporarily store the bills inserted by the user and the bills to be provided to the user before completion of the user's specified transaction. The left-bill collection cabinet 61 is used to collect the bills left behind in the cash slot 21 by the user at the time of a cash deposit transaction or a cash withdrawal transaction. The counterfeit collection cabinet 62 is used to collect the bills identified as counterfeits by the bill validator 30. The supply/recovery cabinet 63 is used to store bills to be supplied to recycle cartridges 81 and 82 and bills recovered from the recycle cartridges 81 and 82 as discussed later. The six switchover gates 50*a* through 50*f* are used to change over the conveyance route of bills.

The lower conveyance mechanism 10*b* is provided below the upper conveyance mechanism 10*a* to be surrounded by the vault casing 106. The lower conveyance mechanism 10*b* includes a cash deposit cartridge 60, two cash withdrawal cartridges 71 and 72, two recycle cartridges 81 and 82, a reject cartridge 83, five switchover gates 50*g* through 50*k*, and a bill conveyor path (shown by arrows).

The cash deposit cartridge 60 is used to store bills received in each effected cash deposit transaction. The two cash withdrawal cartridges 71 and 72 are used to store bills to be provided in each effected cash withdrawal transaction. The two recycle cartridges 81 and 82 are used as the cash deposit cartridges in combination with the cash withdrawal cartridges. The reject cartridge 83 is used to store damaged bills inadequate for withdrawal (for example, broken bills and heavily folded bills). Like the six switchover gates 50*a* through 50*f* discussed above, the five switchover gates 50*g* through 50*k* are used to change over the conveyance route of bills.

Each of the bill conveyor paths provided in the upper conveyance mechanism 10*a* and in the lower conveyance mechanism 10*b* includes belts (not shown) for holding bills, rollers (not shown) for driving the belts, motors (not shown) for actuating the rollers, and pulleys for supporting the belts. In one application, a driving motor may be provided for each of the rollers. In another application, one single motor may be used to drive multiple rollers.

The bill conveyor path in the upper conveyance mechanism 10*a* and the bill conveyor path in the lower conveyance mechanism 10*b* are interconnected via a slit SL provided on an upper face of the vault casing 106. Banknotes or bills are conveyable bi-directionally between the upper conveyance mechanism 10*a* and the lower conveyance mechanism lob. The structure of making the lower conveyance mechanism 10*b* surrounded by the vault casing 106 and interconnecting the upper conveyance mechanism 10*a* and the lower conveyance mechanism 10*b* only through the slit SL strictly restricts access to and securely protects the cash deposit cartridge 60 and the other cash cartridges for storing a large mass of banknotes or bills, thus ensuring the high security.

The respective constituents of the upper conveyance mechanism 10*a* and the lower conveyance mechanism 10*b* are electrically connected to a control circuit 300.

Figure 3:
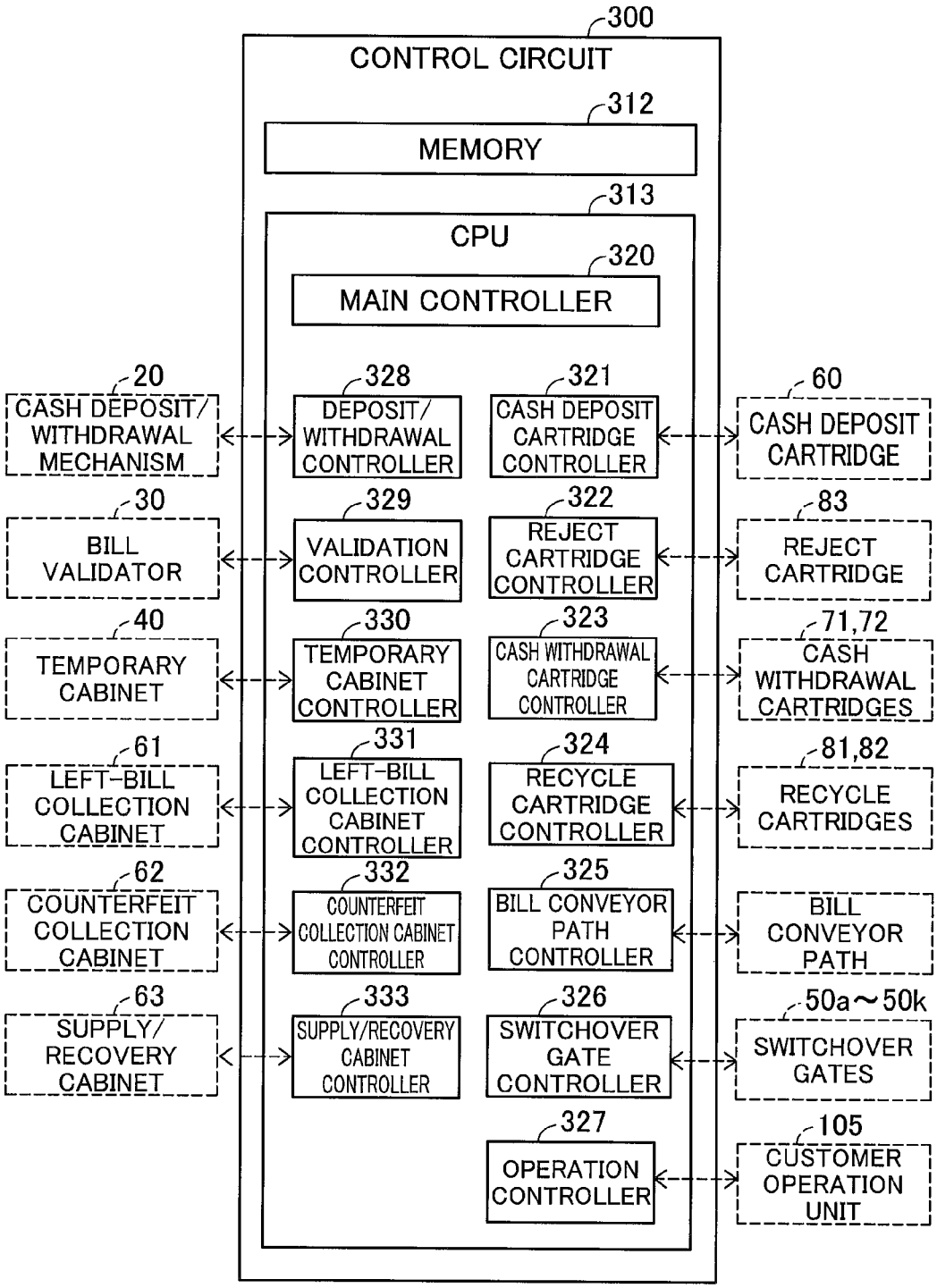
FIG 3 is an explanatory diagram showing the structure of the control circuit.

FIG. 3 is an explanatory diagram showing the structure of the control circuit 300. The control circuit 300 has a memory 312 and a CPU (central processing unit) 313. The memory 312 includes a ROM (read only memory) and a RAM (random access memory). The CPU 313 executes control programs stored in the memory 312 to function as a main controller 320, a cash deposit cartridge controller 321, a reject cartridge controller 322, a cash withdrawal cartridge controller 323, a recycle cartridge controller 324, a bill conveyor path controller 325, a switchover gate controller 326, an operation controller 327, a deposit/withdrawal controller 328, a validation controller 329, a temporary cabinet controller 330, a left-bill collection cabinet controller 331, a counterfeit collection cabinet controller 332, and a supply/recovery cabinet controller 333.

The main controller 320 performs the overall control of the whole automated teller machine 500. The cash deposit cartridge controller 321 controls the storage and delivery of bills in and from the cash deposit cartridge 60. The reject cartridge controller 322 controls the storage and delivery of bills in and from the reject cartridge 83. The cash withdrawal cartridge controller 323 controls the storage and delivery of bills in and from the two cash withdrawal cartridges 71 and 72. The recycle cartridge controller 324 controls the storage and delivery of bills in and from the two recycle cartridges 81 and 82. The bill conveyor path controller 325 controls the motors (not shown) provided in the bill conveyor paths. The switchover gate controller 326 controls the eleven switchover gates 50*a* through 50*k*. The operation controller 327 controls the customer operation unit 105. The deposit/withdrawal controller 328 controls the cash deposit/withdrawal mechanism 20. The validation controller 329 controls the bill validator 30. The temporary cabinet controller 330 controls the storage and delivery of bills in and from the temporary cabinet 40. The left-bill collection cabinet controller 331 controls the storage and delivery of bills in and from the left-bill collection cabinet 61. The counterfeit collection cabinet controller 332 controls the storage and delivery of bills in and from the counterfeit collection cabinet 62. The supply/recovery cabinet controller 333 controls the storage and delivery of bills in and from the supply/recovery cabinet 63.

Figure 4A:
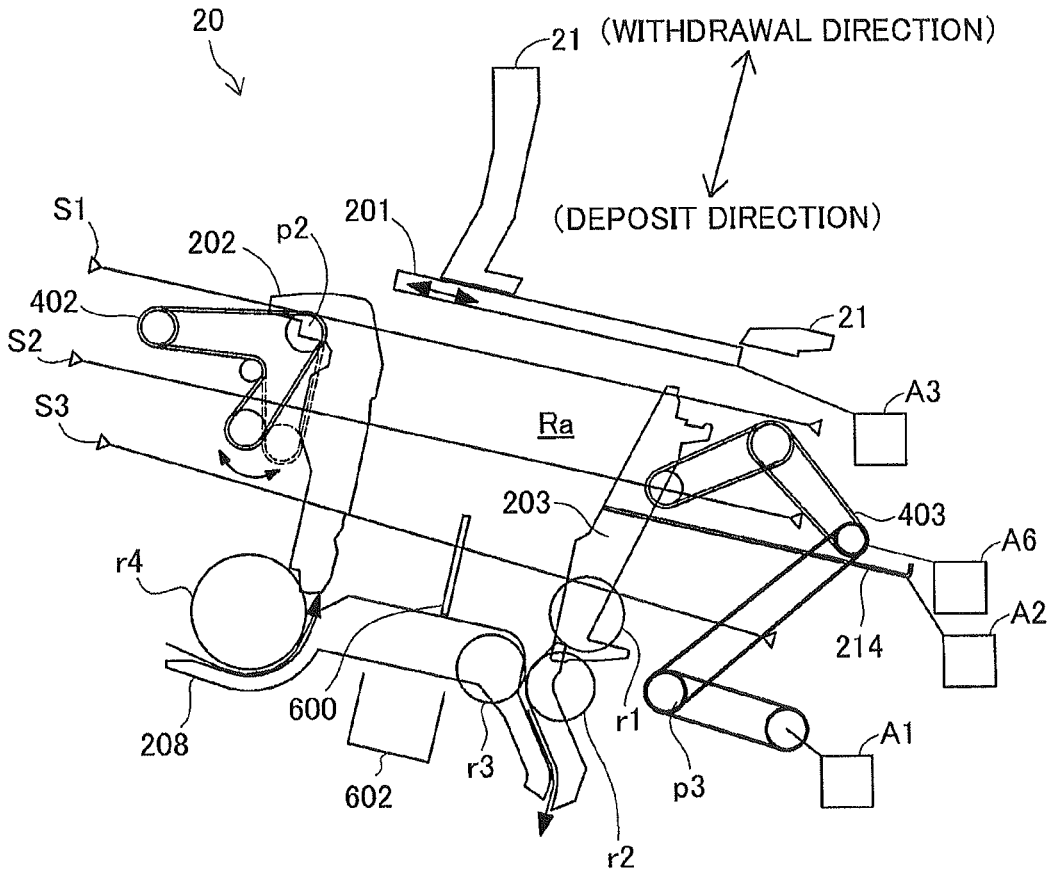
FIG. 4A is the first explanatory diagram showing the detailed structure of the cash deposit/withdrawal mechanism 20.
Figure 4B:
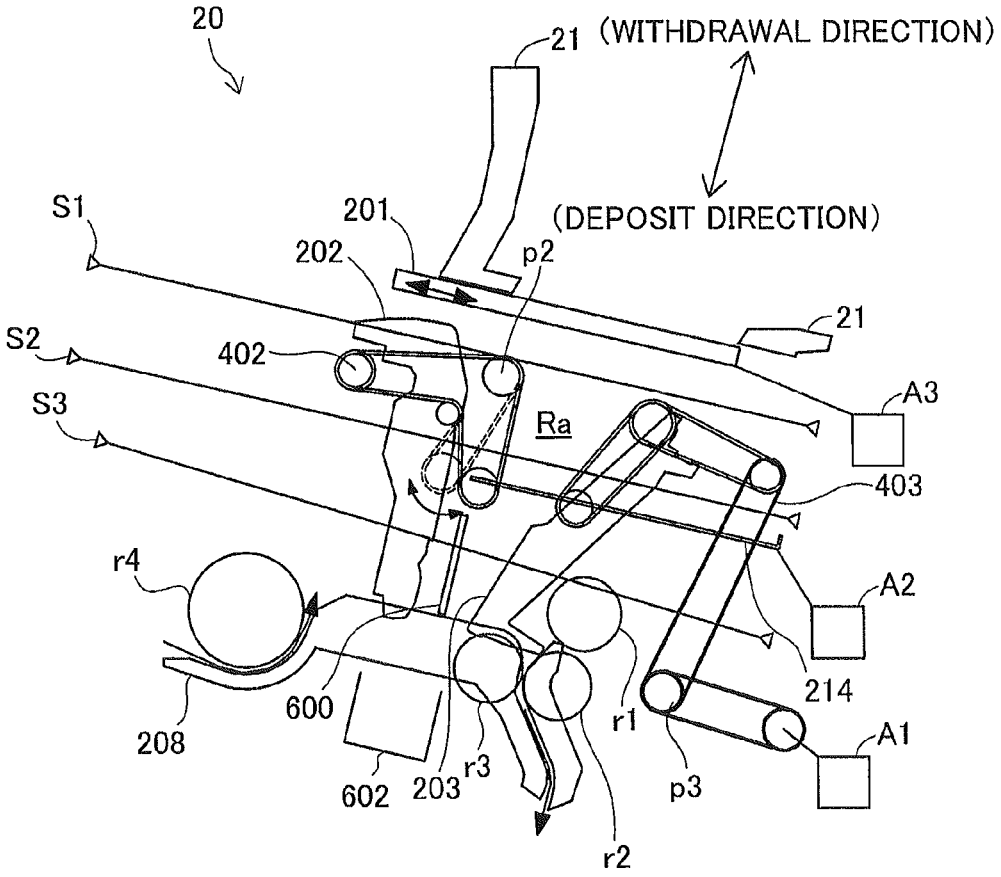
FIG. 4B is the second explanatory diagram showing the detailed structure of the cash deposit/withdrawal mechanism 20.

FIG. 4A is the first explanatory diagram showing the detailed structure of the cash deposit/withdrawal mechanism 20. FIG. 4B is the second explanatory diagram showing the detailed structure of the cash deposit/withdrawal mechanism 20. The cash deposit/withdrawal mechanism 20 includes a shutter 201, a front push plate 203, a rear push plate 202, a front clamping mechanism 403, a rear clamping mechanism 402, a partition plate 600, a bottom plate 208, a foreign substance receiving box 602, a stopper 214, four actuators A1 through A3 and A6, three sensors S1 through S3, a pick roller r1, a separation roller r2, a gate roller r3, and a stack roller r4. The cash deposit/withdrawal mechanism 20 is arranged to be inclined to the direction of gravity (vertical direction).

The shutter 201 prevents invasion of raindrops, dust, and foreign substances into the automated teller machine 500. The shutter 201 is provided along the cash slot 21 to be slidable in a direction perpendicular to a bill inserting direction (hereafter referred to as 'deposit direction') and to a bill delivering direction (hereafter referred to as 'withdrawal direction').

The front push plate 203 is constructed as a plate member and is arranged to be substantially parallel to each of the bills (not shown) inserted through the cash slot 21. As shown FIG. 4A and FIG. 4B, the front push plate 203 is arranged to be pivotally rotatable about its upper end (an end closer to the cash slot 21). The front push plate 203 is movable between two preset positions, a solid-line position relatively closer to the rear push plate 202 (hereafter referred to as 'bill-receiving position') shown in FIG. 4B and a position relatively farther away from the rear push plate 202 (hereafter referred to as 'bill-loading position') shown in FIG. 4A. The front push plate 203 is moved by an actuator (not shown). Here the terminology 'front' means the front side seen from the user.

The rear push plate 202 is constructed as a plate member like the front push plate 203 and is arranged to be substantially parallel to the front push plate 203. As shown in FIG. 4A and FIG. 4B, the rear push plate 202 is arranged to be slidable in a direction perpendicular to the deposit direction (that is, in a direction parallel to the shutter 201). The rear push plate 202 is movable between two preset positions, a solid-line position relatively closer to the front push plate 203 (hereafter referred to as 'bill-receiving position') shown in FIG. 4B and a position relatively farther away from the front push plate 203 (hereafter referred to as 'bill-loading position') shown in FIG. 4A. The rear push plate 202 is slid by an actuator (not shown). The front push plate 203 and the rear push plate 202 give an adequate pressing force to each of the bills inserted through the cash slot 21. Here the terminology 'rear' means the rear side seen from the user.

The front clamping mechanism 403 includes belts (clamp belts) for conveying bills, pulleys for driving the clamp belts, and pulleys for supporting the clamp belts (for example, a pulley p3 shown FIG. 4A and FIG. 4B). The clamp belts are drivable both in a bill-receiving direction and in a bill-delivering direction. As shown FIG. 4A and FIG. 4B, part of the front clamping mechanism 403 is arranged to be pivotally rotatable about the pulley p3. The front clamping mechanism 403 is movable among three preset positions, a solid-line position relatively closer to the rear clamping mechanism 402 (hereafter referred to as 'deposit position'), a broken-line position relatively farther away from the rear clamping mechanism 402 (hereafter referred to as 'retreat position'), and a discharge position (not shown). The front clamping mechanism 403 is moved by the actuator A6. The detailed structure of the front clamping mechanism 403 will be discussed later.

As shown FIG. 4A and FIG. 4B, the rear clamping mechanism 402 is arranged to be slidable in the direction perpendicular to the deposit direction. The rear clamping mechanism 402 is movable among three preset positions, a contact position (not shown) in contact with the front clamping mechanism 403 (hereafter referred to as 'clamping position'), a position relatively closer to the front clamping mechanism 403 (hereafter referred to as 'discharge position'), shown in FIG. 4B and a position relatively farther away from the front clamping mechanism 403 (hereafter referred to as 'retreat position') shown in FIG. 4A. The detailed structure of the rear clamping mechanism 402 will be discussed later.

The front clamping mechanism 403 and the rear clamping mechanism 402 described above work in combination as a pair of clamping mechanisms to clamp bills and convey the bills in either the deposit direction or the withdrawal direction in a bill accumulation area Ra.

The pair of clamping mechanisms 402 and 403 move in mutually approaching directions or in mutually away directions. Similarly the pair of push plates 202 and 203 move in mutually approaching directions or in mutually away directions. The pair of clamping mechanisms 402 and 403 may thus be located at any positions between inner positions inside the pair of push plates 202 and 203 (that is, positions between the front push plate 203 and the rear push plate 202) and external positions outside the pair of push plates 202 and 203 (that is, positions across the front push plate 203 and the rear push plate 202). As shown 4A and FIG. 4B, the pair of clamping mechanisms 402 and 403 may be located in positions overlapping with the pair of push plates 202 and 203. In this case, the front clamping mechanism 403 and the rear clamping mechanism 402 are respectively received in notches (not shown) formed in the corresponding push plates.

The partition plate 600 is constructed as a plate member and is arranged between and in parallel with the front push plate 203 and the rear push plate 202. The partition plate 600 is arranged to be slidable between the front push plate 203 and the rear push plate 202. The partition plate 600 is slid by an actuator (not shown). The bottom plate 208 is constructed as a plate member with a slit and is arranged on the opposite side of the cash slot 21 across the bills inserted via the cash slot 21. The pair of push plates 202 and 203, the pair of clamping mechanisms 402 and 403, the bottom plate 208, and side plates (not shown) define the bill accumulation area Ra. The bill accumulation area Ra is set to temporarily accumulate the bills inserted through the cash slot 21 or the bills to be delivered through the cash slot 21.

The foreign substance receiving box 602 is provided to accumulate any foreign substances that invade through the cash slot 21 into the bill accumulation area Ra and fall through the slit of the bottom plate 208. The stopper 214 receives the bills inserted through the cash slot 21. The stopper 214 is arranged to be slidable in parallel with the shutter 201 and to be movable between a position exposed to the bill accumulation area Ra (hereafter referred to as 'bill-receiving position') shown in FIG. 4B and a position not exposed to the bill accumulation area Ra (hereafter referred to as 'retreat position') shown in FIG. 4A. In the initial state, the stopper 214 is located at the bill-receiving position shown in FIG. 4B. The position of the stopper 214 is determined, such that the distance between the cash slot 21 and the stopper 214 is shorter than the length of each inserted bill in its height direction (that is, in the deposit direction).

The actuator A1 actuates the pulleys provided in the front clamping mechanism 403 to drive the belts. The actuator A2 slides the stopper 214, while the actuator A3 slides the shutter 201. The actuator A6 moves part of the front clamping mechanism 403.

The three sensors S1 through S3 are aligned in the direction perpendicular to the deposit direction. Among the three sensors S1 through S3, the sensor S1 is located closest to the cash slot 21, and the sensor S3 is located farthest away from the cash slot 21. The sensor S2 is located between the two sensors S1 and S3. Each of these sensors S1 through S3 is an optical sensor having a light source and a light-receiving element. Each of the sensors S1 through S3 senses the light shielding state or the non-light shielding state to detect the presence or the absence of any bill accumulated in the bill accumulation area Ra.

The pick roller r1 picks up the bills accumulated in the bill accumulation area Ra one by one. The separation roller r2 feeds each bill picked up by the pick roller r1 into the bill conveyor path. The gate roller r3 is arranged at a position overlapping with the separation roller r2 to prevent simultaneous feed of multiple bills. The stack roller r4 carries the bills conveyed through the bill conveyor path into the bill accumulation area Ra.

Figure 5:
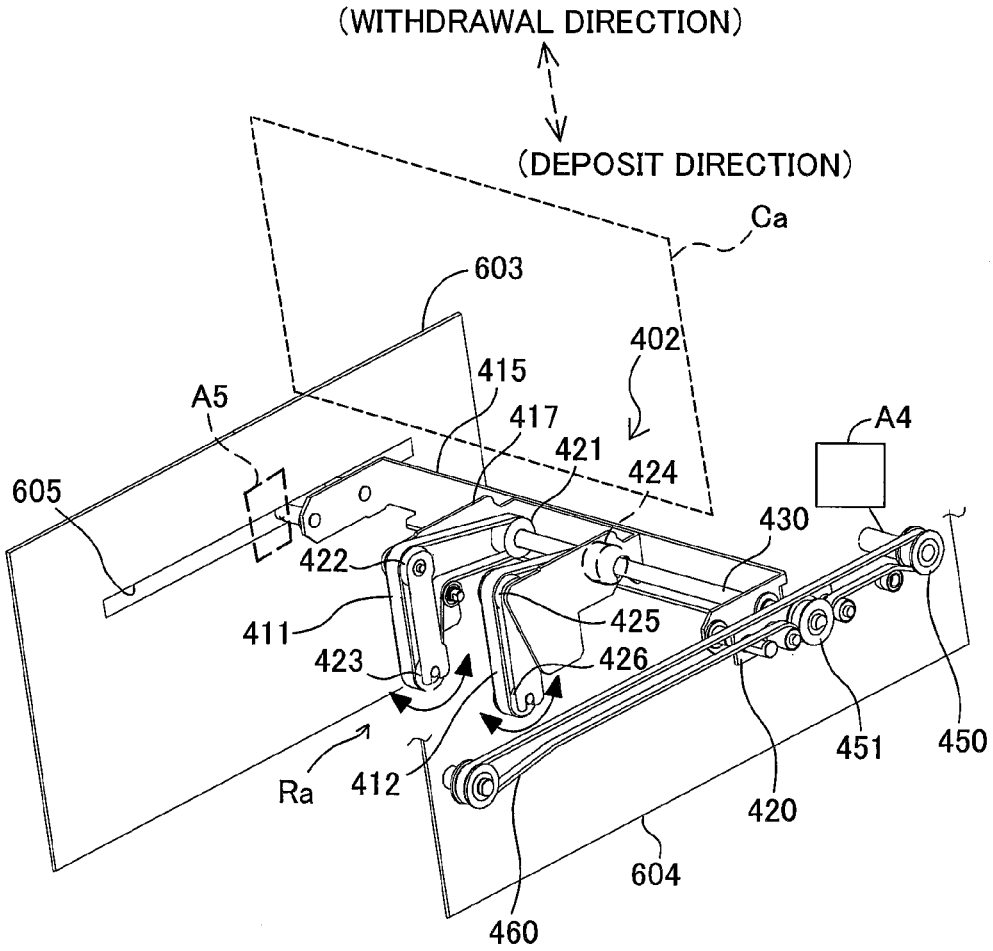
FIG. 5 is an explanatory diagram showing the detailed structure of the rear clamping mechanism.

FIG. 5 is an explanatory diagram showing the detailed structure of the rear clamping mechanism 402. The rear clamping mechanism 402 includes a guide plate 415, a support plate member 417, a slide plate 420, a drive shaft 430, six pulleys 421 through 426, and two clamp belts 411 and 412. For the convenience of explanation, some constituents other than the rear clamping mechanism 402 (two frames 603 and 604, a first drive pulley 450, a drive belt 460, a second drive pulley 451, and two actuators A4 and A5) are also shown in FIG. 5.

The guide plate 415 is located between the two frames 603 and 604 to be perpendicular to the frames 603 and 604. Both ends of the guide plate 415 have bent edges extended in parallel with the two frames 603 and 604. The support plate member 417 is formed in a U shape and is attached to a center area of the guide plate 415. The support plate member 417 supports the four pulleys 421, 422, 424, and 425. The slide plate 420 is a plate member arranged to be parallel to the bent edge of the guide plate 415.

The drive shaft 430 is a columnar member located in parallel with the guide plate 415. The drive shaft 430 is arranged to pass through the two frames 603 and 604, the slide plate 420, the bent edges of the guide plate 415, and the two pulleys 421 and 424. One end of the drive shaft 430 passes through the slide plate 420 and is protruded from a slit (not shown) formed in the frame 604, while the other end of the drive shaft 430 is protruded from a slit 605 formed in the frame 603.

The pulleys 421 and 422 are aligned in a direction perpendicular to the deposit direction. The pulleys 421 and 423 are aligned in the deposit direction. The clamp belt 411 is looped over the three pulleys 421 through 423. The pulley 424 is located apart from the pulley 421 by a predetermined distance along the drive shaft 430. The pulleys 424 and 425 are aligned in the direction perpendicular to the deposit direction. The pulleys 425 and 426 are aligned in the deposit direction. The clamp belt 412 is looped over the three pulleys 424 through 426. The pulleys 422 and 425 correspond to a pulley p2 shown in FIG. 4A and FIG. 4B.

The two pulleys 421 and 424 are attached to a central portion of the drive shaft 430 between the two frames 603 and 604. The two clamp belts 411 and 412 are thus located in a central part of each inserted bill Ca in its width direction.

The pulley 423 is arranged to be pivotally movable (rotatable) about the pulley 422. In the absence of any bill in the bill accumulation area Ra, the pulley 423 is pressed by a spring (not shown) in a direction approaching the opposed front clamping mechanism 403. In the case of insertion of a bill or delivery of a bill, on the other hand, the pulley 423 is moved in a direction away from the front clamping mechanism 403 according to the thickness of the bill. In this state, the pulley 423 applies a pressing force onto the bill. The pulley 426 has the similar structure to that of the pulley 423 and is not explained specifically.

The two frames 603 and 604 are thin plate members having rectangular planes. As shown in FIG. 5, the frame 603 has the slit 605 formed along its longitudinal direction. The frame 604 has a similar slit at the same position as the frame 603. For the convenience of illustration, an upper half of the frame 604 including the slit is omitted from the illustration of FIG. 5. The two frames 603 and 604 are arranged to be parallel to each other. The distance between the two frames 603 and 604 is determined to be slightly longer than the length of each inserted bill Ca in its width direction.

The first drive pulley 450 and the second drive pulley 451 are attached to the frame 604. The drive belt 460 is looped over the two drive pulleys 450 and 451. The actuator A4 is located independently of the rear clamping mechanism 402 and the two frames 603 and 604. The actuator A5 is located outside the frame 603 and is connected with the guide plate 415 via the slit 605 of the frame 603.

The first drive pulley 450 is connected with and is driven by the actuator A4. The actuator A4 allows for drive the first drive pulley 450 in either of two directions. The drive belt 460 is driven by the rotation of the first drive pulley 450. The second drive pulley 451 is joined with one end of the drive shaft 430 on the side of the frame 604. The drive belt 460 is wound on second drive pulley 451, so that the second drive pulley 451 is driven and rotated by the drive belt 460.

The two clamp belts 411 and 412 are driven in the following manner. The drive shaft 430 is driven and rotated with the rotation of the second drive pulley 451. The two pulleys 421 and 424 attached to the drive shaft 430 are activated in a mutually synchronous manner with the rotation of the drive shaft 430. The two clamp belts 411 and 412 are driven by the activation of these two pulleys 421 and 424. The two clamp belts 411 and 412 are drivable either in a direction of receiving each inserted bill (hereafter referred to as 'receiving direction') or in a direction of delivering each bill (hereafter referred to as 'delivery direction') according to the driving direction of the first drive pulley 450.

The rear clamping mechanism 402 has the sliding motion as mentioned above. The actuator A5 slides the guide plate 415 along the slit 605 in a direction perpendicular to the deposit direction. The drive shaft 430 and the support plate member 417 are slid, accompanied with the sliding motion of the guide plate 415. The sliding motion of the support plate member 417 results in sliding the six pulleys 421 through 426 and the two clamp belts 411 and 412. The sliding motion of the drive shaft 430 results in sliding the second drive pulley 451 joined with the end of the drive shaft 430. The second drive pulley 451 with the drive belt 460 wound thereon is arranged to be slidable. Irrespective of the sliding motion of the drive shaft 430 to any position, the driving force of the actuator A4 is transmittable via the second drive pulley 451 to the drive shaft 430.

Figure 6:
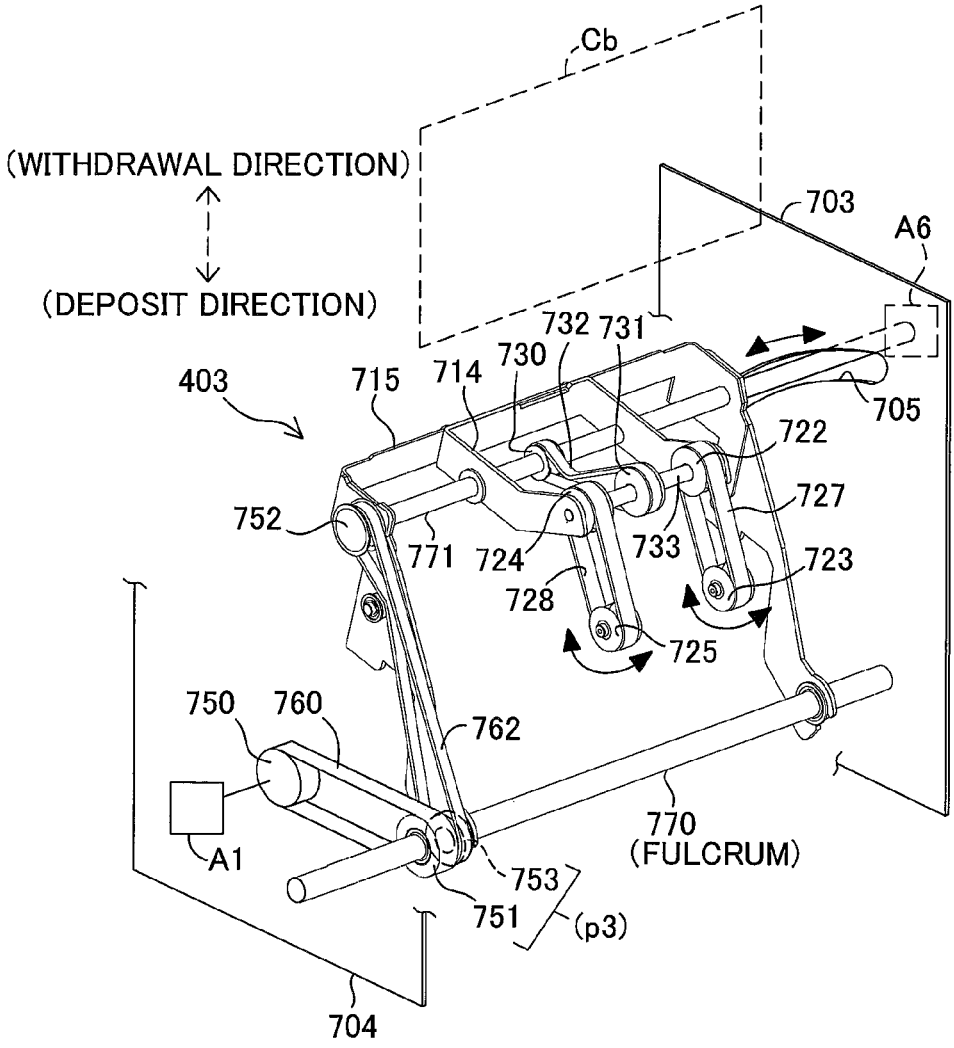
FIG. 6 is an explanatory diagram showing the detailed structure of the front clamping mechanism.

FIG. 6 is an explanatory diagram showing the detailed structure of the front clamping mechanism 403. The front clamping mechanism 403 includes a guide plate 715, a support plate member 714, a first drive shaft 770, a second drive shaft 771, a third drive shaft 733, ten pulleys 722 through 725, 730, 731, and 750 through 753, two clamp belts 727 and 728, a first drive belt 760, a second drive belt 762, and a third drive belt 732. For the convenience of explanation, some constituents other than the front clamping mechanism 403 (two frames 703 and 704 and two actuators A1 and A6) are also shown in FIG. 6.

The guide plate 715 is located between the two frames 703 and 704 to be perpendicular to the frames 703 and 704. Both ends of the guide plate 715 have bent edges extended in parallel with the two frames 703 and 704. The support plate member 714 is formed in a U shape and is attached to a center area of the guide plate 715. The support plate member 714 supports the four pulleys 722 through 725. The two pulleys 723 and 725 are connected to the support plate member 714 by means of support members (not shown). The respective ends of the two bent edges of the guide plate 715 are supported by the first drive shaft 770.

The first drive shaft 770 is a columnar member located in parallel with the guide plate 715. The first drive shaft 770 is arranged to pass through the two pulleys 751 and 752 and is supported by the two frames 703 and 704. The first drive shaft 770 is rotatable about a center shaft in its longitudinal direction. The two pulleys 751 and 753 correspond to the pulley p3 shown in FIG. 4A and FIG. 4B. The second drive shaft 771 is a columnar member located in parallel with the guide plate 715. The second drive shaft 771 is arranged to pass through the bent edges of the guide plate 715, the support plate member 714, and the pulley 730. One end of the second drive shaft 771 is connected with the pulley 752, while the other end of the second drive shaft 771 is protruded from a slit 705 formed in the frame 703. The actuator A6 is connected with the end of the second drive shaft 771 protruded from the slit 705. The third drive shaft 733 is supported in a rotatable manner by one end of the support plate member 714. The third drive shaft 733 is arranged to pass through the pulley 731 at an intermediate position, pass through the pulley 722 at one end position, and pass through the pulley 724 at the other end position.

The pulleys 722 and 723 are aligned in a direction substantially parallel to the deposit direction and the withdrawal direction. The clamp belt 727 is looped over these pulleys 722 and 723. Similarly the pulleys 724 and 725 are aligned in the direction substantially parallel to the deposit direction and the withdrawal direction. The clamp belt 728 is looped over these pulleys 724 and 725. The two clamp belts 727 and 728 are located in an intermediate position between the two frames 703 and 704 and are thus positioned in a central part of each inserted bill Cb in its width direction. The third drive belt 732 is looped over the two pulleys 731 and 730.

The first drive belt 760 is looped over the two pulleys 750 and 751. The actuator A1 is connected with the pulley 750 to actuate the pulley 750. The second drive belt 762 is looped over the two pulleys 752 and 753.

The pulley 723 is arranged to be pivotally movable (rotatable) about the pulley 722. In the absence of any bill in the bill accumulation area Ra, the pulley 723 is pressed by a spring (not shown) in a direction approaching the opposed rear clamping mechanism 402. In the case of insertion of a bill or delivery of a bill, on the other hand, the pulley 723 is moved in a direction away from the rear clamping mechanism 402 according to the thickness of the bill. In this state, the pulley 723 applies a pressing force onto the bill. The pulley 725 has the similar structure to that of the pulley 723 and is not explained specifically.

The two frames 703 and 704 are thin plate members having rectangular planes. The frame 703 has the arc-shaped slit 705. For the convenience of illustration, an upper half of the frame 704 is omitted from the illustration of FIG. 6. The two frames 703 and 704 are arranged to be parallel to each other. The distance between the two frames 703 and 704 is determined to be slightly longer than the length of each inserted bill Cb in its width direction.

The two clamp belts 727 and 728 are driven in the following manner. In response to actuation of the pulley 750 by the actuator A1, the pulley 751 is rotated via the first drive belt 760. The rotation of the pulley 751 leads to the rotation of the first drive shaft 770, so that the pulley 753 attached to the first drive shaft 770 rotates synchronously to drive the second drive belt 762. The driving force of the second drive belt 762 is transmitted to the pulley 752, the second drive shaft 771, and the pulley 730 to drive the third drive belt 732. The drive power of the third drive belt 732 causes the third drive shaft 733 to be rotated via the pulley 731. Namely the two pulleys 722 and 724 rotate in a mutually synchronous manner. Such actuation of the two pulleys 722 and 724 drives the two clamp belts 727 and 728. The two clamp belts 727 and 728 are drivable either in the receiving direction or in the delivery direction according to the driving direction of the pulley 750.

The following describes the moving operations of the whole front clamping mechanism 403. The actuator A6 moves the second drive shaft 771 along the arc shape of the slit 705. Accompanied with the arc motion of the second drive shaft 771, the guide plate 715 and the support plate member 714 move in an arc shape about the first drive shaft 770. Namely the whole front clamping mechanism 403 moves in an arc shape. Irrespective of the position of the front clamping mechanism 403, the driving force of the actuator A1 is transmittable to the two clamp belts 727 and 728 by the pathway discussed above. The clamp belts 727 and 728 can thus convey each inserted bill Cb (or each bill Cb to be delivered), regardless of the position of the front clamping mechanism 403.

The pair of clamping mechanisms 402 and 403 discussed above are equivalent to the pair of conveyor assemblies in the claims of the invention. The two actuators A5 and A6 correspond to the moving mechanism in the claims of the invention. The drive shaft 430 is equivalent to the transmission structure in the claims of the invention. The sensors S1 through S3 and the deposit/withdrawal controller 328 correspond to the detection unit in the claims of the invention. The deposit/withdrawal controller 328 corresponds to the determination module and the moving distance measurement unit in the claims of the invention.

A2. Operations of Cash Deposit/Withdrawal Mechanism 20 at the Time of Cash Deposit Transaction The operations of the cash deposit/withdrawal mechanism 20 at the time of a cash deposit transaction are described below as one bill-receiving example of the cash deposit/withdrawal mechanism 20. When the user operates the customer operation unit 105 (FIG. 1) to select a cash deposit transaction option, the cash deposit/withdrawal mechanism 20 starts a cash receiving process. Prior to execution of the cash receiving process, the pair of push plates 202 and 203 are located at the bill-loading positions, while the pair of clamping mechanisms 402 and 403 are located at the retreat positions.

Figure 7:
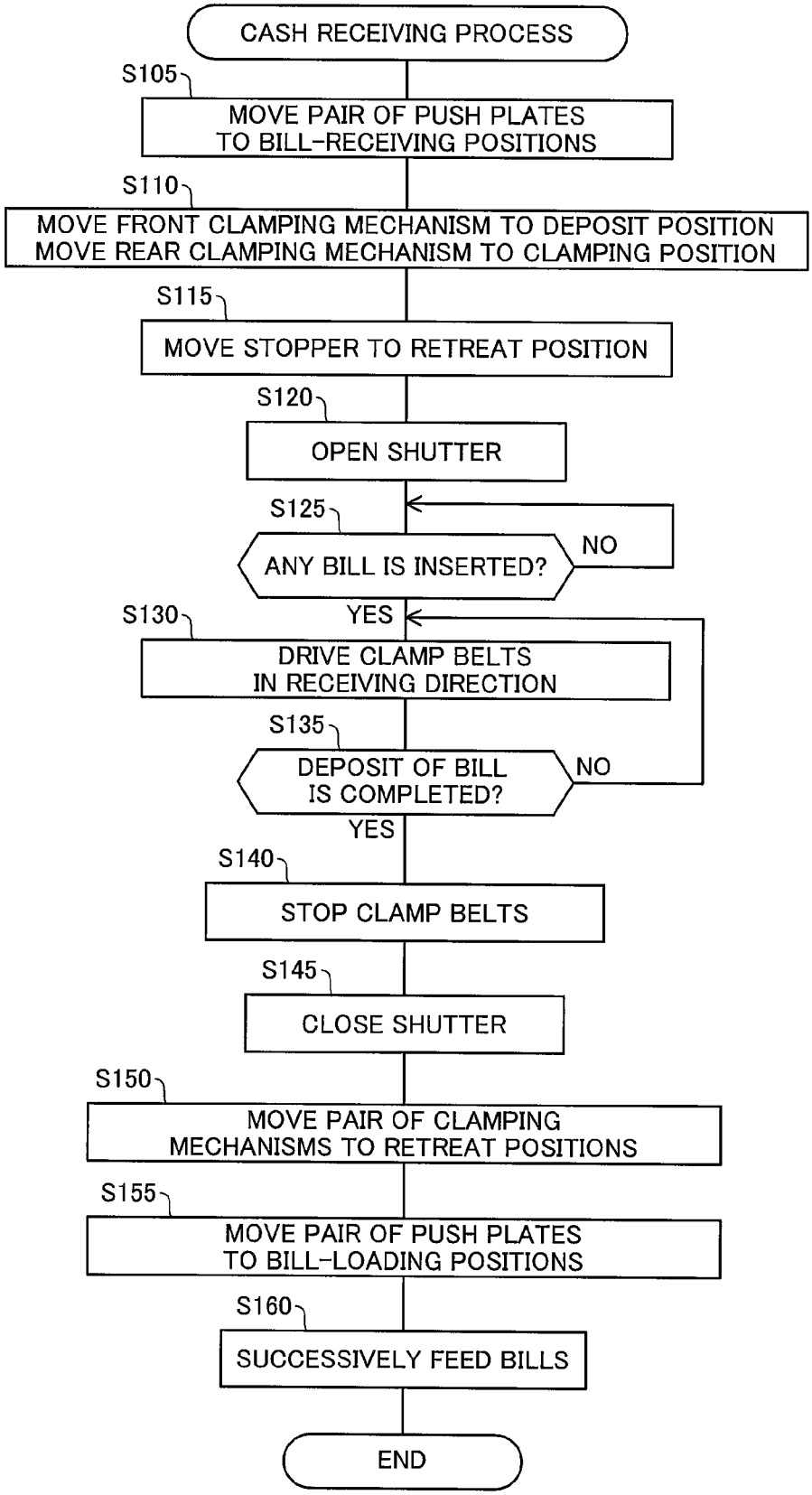
FIG. 7 is a flowchart showing the details of the cash receiving process executed by the cash deposit/withdrawal mechanism.

FIG. 7 is a flowchart showing the details of the cash receiving process executed by the cash deposit/withdrawal mechanism 20. The deposit/withdrawal controller 328 (FIG. 3) controls the actuators (not shown) to move the pair of push plates 202 and 203 (FIG. 4B) to the bill-receiving positions (step S105). The deposit/withdrawal controller 328 also controls the actuator A6 (FIG. 4B) to move the front clamping mechanism 403 to the deposit position, while controlling the actuator AS (FIG. 5) to move the rear clamping mechanism 402 to the clamping position (step S110). In this state, the pair of clamping mechanisms 402 and 403 (specifically the clamp belts) come into contact with each other at the positions of the pulleys on the lower ends.

The deposit/withdrawal controller 328 controls the actuator A2 (FIG. 4B) to move the stopper 214 to the retreat position (step S115), and subsequently controls the actuator A3 (FIG. 4B) to open the shutter 201 (step S120).

After the shutter 201 opens, the user is allowed to insert bills into the cash slot 21 (FIG. 1). The deposit/withdrawal controller 328 detects insertion of any bill based on the output of the sensor S1 and waits for insertion of any bill (step S125). In response to insertion of any bill, the light is shielded and the output of the light-receiving element is changed in the sensor S1. The deposit/withdrawal controller 328 can thus detect insertion or non-insertion of any bill, based on a change of the output of the light-receiving element.

Upon detection of insertion of any bill, the deposit/withdrawal controller 328 controls the actuator A4 (FIG. 5) to drive the clamp belts 411 and 412 in the receiving direction (step S130).

Figure 8:
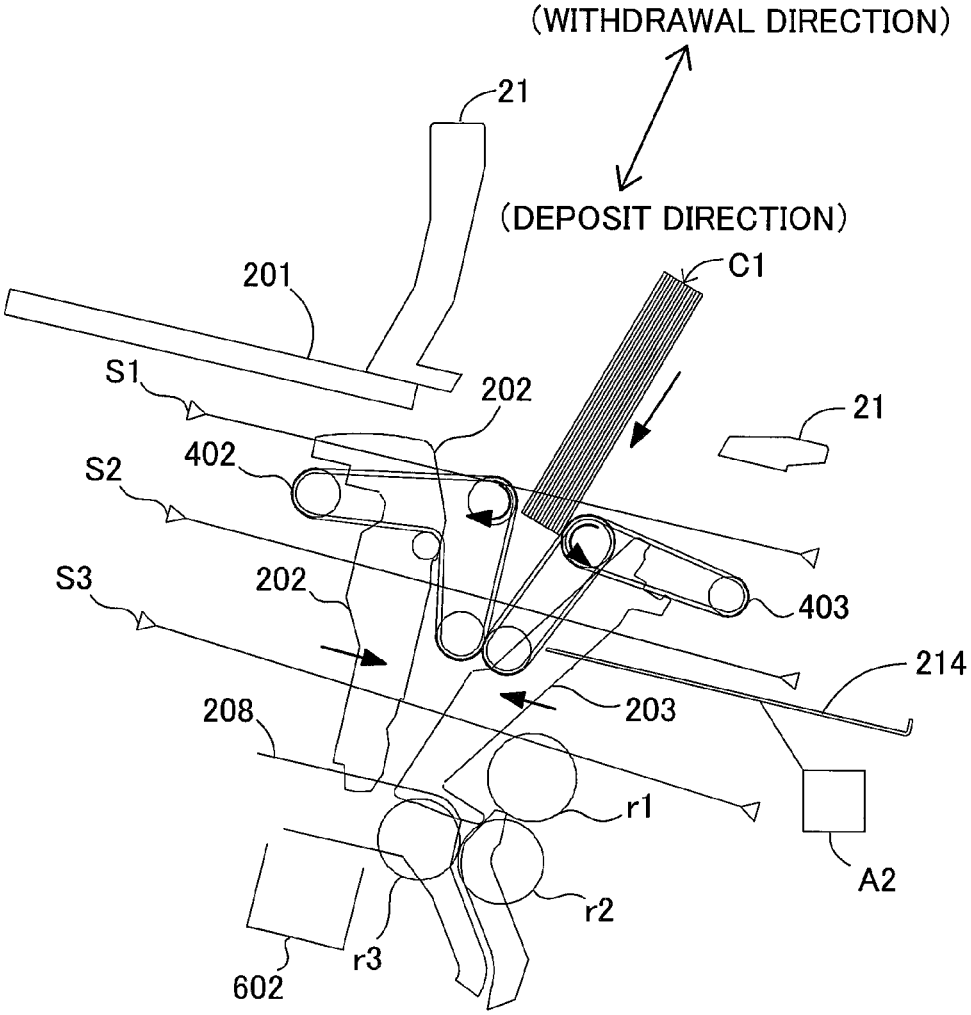
FIG. 8 is an explanatory diagram showing the state of the cash Deposit/withdrawal mechanism after execution of step S130.

FIG. 8 is an explanatory diagram showing the state of the cash deposit/withdrawal mechanism 20 after execution of step S130. For the convenience of illustration, some constituents including the stack roller r4 are omitted from the illustration of FIG. 8. As shown in FIG. 8, in the state where the pair of push plates 202 and 203 are set at the bill-receiving positions, the front clamping mechanism 403 is set at the deposit position, and the rear clamping mechanism 402 is set at the clamping position, the pair of clamping mechanisms 402 and 403 are located between the pair of push plates 202 and 203. In this state, the pair of clamping mechanism 402 and 403 come into contact with each other at the positions of the pulleys on the lower ends (for example, at the positions of the pulleys 423 and 426 shown in FIG. 5) to be arranged in a V shape. The respective belts (for example, the clamp belts 411 and 412 shown in FIG. 5) are driven in the receiving direction. Immediately after insertion of bills C1 into the cash slot 21, the user feels the bills C1 to bump and to be drawn in. When the user releases the bills C1 from the hand, the bills C1 are automatically taken into the automated teller machine 500. This mechanism enables the user to smoothly deposit bills without inserting the hand or fingers via the cash slot 21 into the bill accumulation area Ra.

Figure 9:
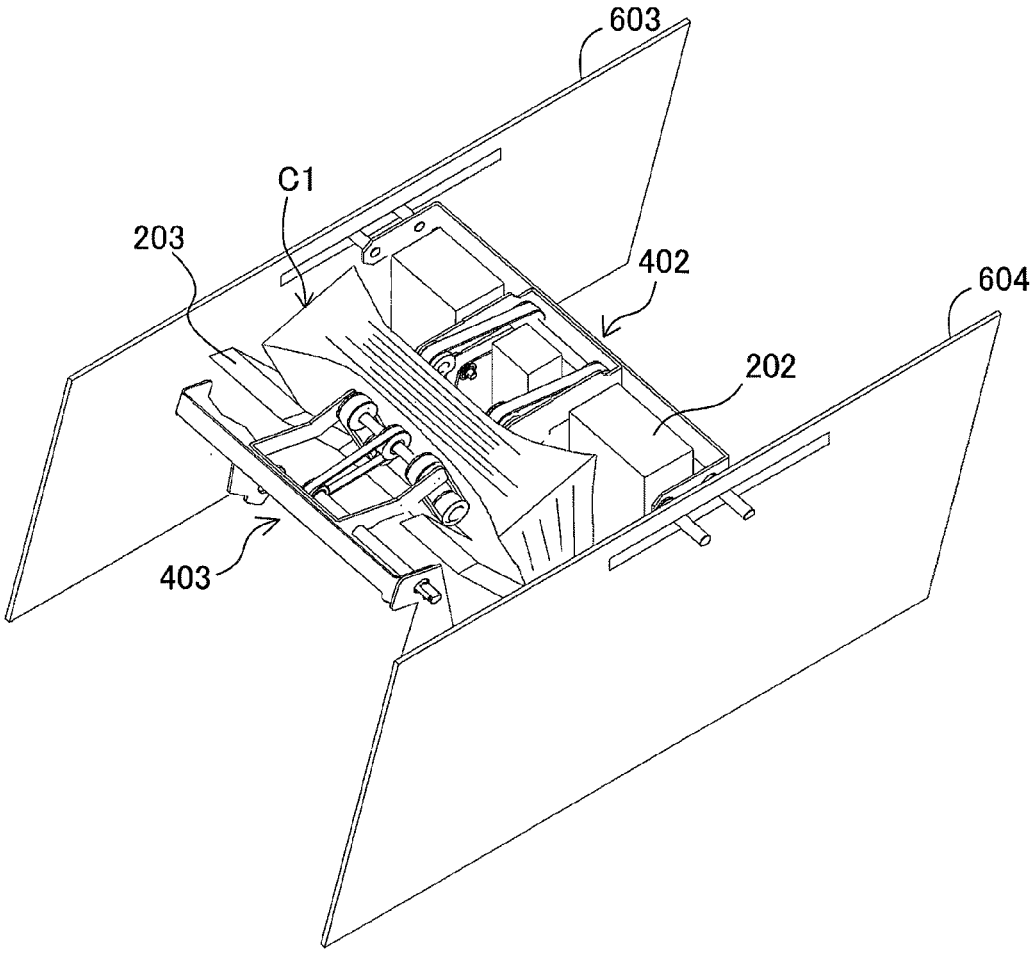
FIG. 9 is an explanatory diagram showing the state of the cash deposit/withdrawal mechanism after execution of step S130.

FIG. 9 is an explanatory diagram showing the state of the cash deposit/withdrawal mechanism 20 after execution of step S130. For the convenience of illustration, some constituents including the shutter 201 and the frames 703 and 704 of the front clamping mechanism 403 are omitted from the illustration of FIG. 9. In the case of depositing a lot of bills, the bundle of bills has a relatively large thickness, and the user generally holds the center of the bundle of bills. The inserted bundle of bills accordingly has both ends spread as shown in FIG. 9. The two clamp belts of the front clamping mechanism 403 are protruded toward the bills C1 from the front push plate 203, while the two clamp belts of the rear clamping mechanism 402 are protruded toward the bills C1 from the rear push plate 202. The two clamp belts of the front clamping mechanism 403 and the two clamp belts of the rear clamping mechanism 402 hold the central part of the bills C1 in the width direction. The both ends of the bundle of bills are accordingly located in a relatively wide space defined by the front push plate 203 and the rear push plate 202. Even when the bundle of bills has the spread ends, the user can readily deposit the bills.

Referring back to the flowchart of FIG. 7, after execution of step S130, the deposit/withdrawal controller 328 determines whether the deposit of bills into the bill accumulation area Ra has been completed based on the outputs of the two sensors S1 and S3 and waits for completion of the deposit of bills (step S135). On completion of the deposit of bills, the light is not shielded in the sensor S1, while the light is shielded in the sensor S3. The deposit/withdrawal controller 328 can thus determine completion of the deposit of bills, based on the outputs of these sensors S1 and S3. In one modification, the procedure may use only the sensor S1 to detect a change from the light shielded state to the light non-shielded state and determine completion of the deposit of bills. In another modification, the procedure may use only the sensor S3 to detect a change from the light non-shielded state to the light shielded state and determine completion of the deposit of bills.

When it is determined that the deposit of bills has been completed (step S135: yes), the deposit/withdrawal controller 328 controls the actuator A4 (FIG. 5) to stop the clamp belts 411 and 412 (step S140).

The deposit/withdrawal controller 328 controls the actuator A3 (FIG. 4B) to close the shutter 201 (step S145). The deposit/withdrawal controller 328 then controls the actuator A6 (FIG. 4) to move the front clamping mechanism 403 to the retreat position, while controlling the actuator A5 (FIG. 5) to move the rear clamping mechanism 402 to the retreat position (step S150). The deposit/withdrawal controller 328 also controls the actuators (not shown) to move the pair of push plates 202 and 203 (FIG. 4B) to the bill-loading positions (step S155). In one modification, the procedure may not move the rear push plate 202 to the bill-loading position but keep the rear push plate 202 at the bill-receiving position.

The deposited bills are accumulated in an upright orientation to be in contact with the bottom plate 208 in the bill accumulation area Ra. Even when the bundle of bills is inserted in an inclined attitude, the inclination of the bills is eliminated during the accumulation in the bill accumulation area Ra. Even when any foreign substance, such as a coin, is present between bills, the foreign substance falls down in the bill accumulation area Ra by means of the gravity, goes through the slit formed in the bottom plate 208, and is received into the foreign substance receiving box 602.

The deposit/withdrawal controller 328 drives the pick roller r1 to pick up the bills accumulated in the bill accumulation area Ra one by one and causes the picked-up bills to successively pass between the separation roller r2 and the gate roller r3 and to be fed into the bill conveyor path (step S160).

At the time of execution of step S160, the front clamping mechanism 403 is retreated outward from the front push plate 203 (that is, to the opposite side of the bills across the front push plate 203). The bills C1 accumulated in the bill accumulation area Ra are thus located to face the front push plate 203 by means of the gravity. In this state, the bills C1 are held by a smooth face without concaves and convexes. This arrangement effectively prevents each of the bills C1 from being conveyed between the separation roller r2 and the gate roller r3 in a folded state or in a bent state as shown in FIG. 9, thus preventing the occurrence of a bill jam.

A3. Operations of Cash Deposit/Withdrawal Mechanism 20 at the Time of Cash Withdrawal Transaction The operations of the cash deposit/withdrawal mechanism 20 at the time of a cash withdrawal transaction are described below as one bill delivery example of the cash deposit/withdrawal mechanism 20 performed on the occasion of, for example, a withdrawal and cancellation of a deposit. When the user operates the customer operation unit 105 (FIG. 1) to select a cash withdrawal transaction option and specify the amount of money, bills corresponding to the specified amount of money are discharged from the two cash withdrawal cartridges 71 and 72 or from the two recycle cartridges 81 and 82, go through the bill conveyor path, and are conveyed to the cash deposit/withdrawal mechanism 20. The cash deposit/withdrawal mechanism 20 then starts a cash delivery process.

Figure 10:
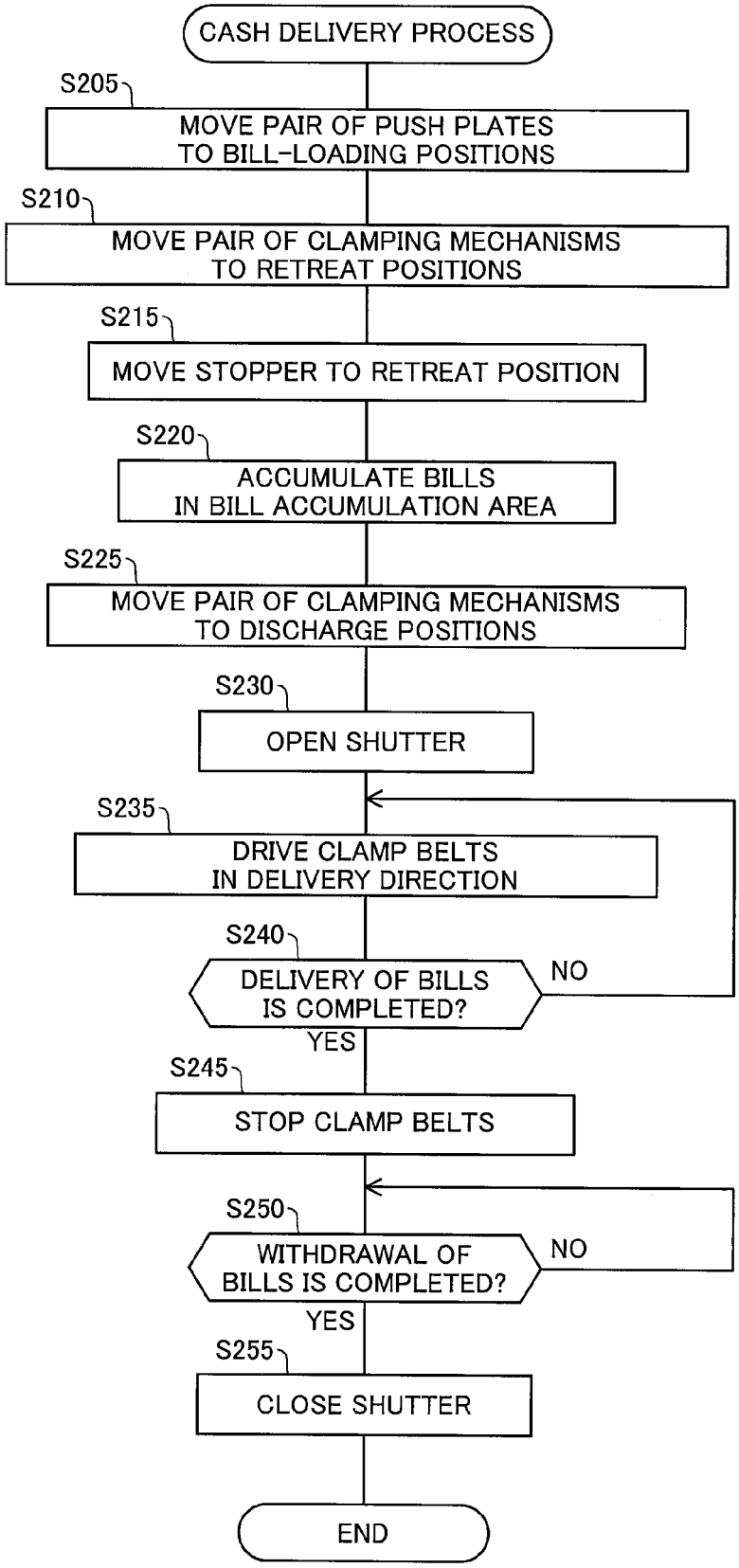
FIG. 10 is a flowchart showing the details of the cash delivery process executed by the cash deposit/withdrawal mechanism.

FIG. 10 is a flowchart showing the details of the cash delivery process executed by the cash deposit/withdrawal mechanism 20. The deposit/withdrawal controller 328 (FIG. 3) controls the actuators (not shown) to move the pair of push plates 202 and 203 (FIG. 4) to the bill-loading positions (step S205). The deposit/withdrawal controller 328 also moves the front clamping mechanism 403 and the rear clamping mechanism 402 to the retreat positions (step S210).

The deposit/withdrawal controller 328 moves the stopper 214 to the retreat position (step S215) and drives the stack roller r4 to accumulate the bills conveyed through the bill conveyor path in the bill accumulation area Ra (step S220). After accumulation of the bills, the deposit/withdrawal controller 328 moves the pair of clamping mechanisms 402 and 403 to the discharge positions (step S225). In the case where the bundle of bills to be delivered has a relatively large thickness, the pair of clamping mechanism 402 and 403 are bumped into the bundle of bills to stop, before reaching the discharge positions. The deposit/withdrawal controller 328 may detect the accumulation of bills in the bill accumulation area Ra, based on the outputs of the sensors S3 and S2.

The deposit/withdrawal controller 328 opens the shutter 201 (step S230) and drives the clamp belts 411 and 412 in the delivery direction (step S235). The deposit/withdrawal controller 328 then determines whether delivery of bills has been completed based on the output of the sensor S3 (step S240) and continues driving the clamp belts 411 and 412 until completion of the delivery of bills. On completion of the delivery of bills, part of the bills is exposed on the cash slot 21. In this state, the light is not shielded in the sensor S3. The deposit/withdrawal controller 328 can thus detect the light non-shielded state of the sensor S3 to determine completion of the delivery of bills.

Figure 11:
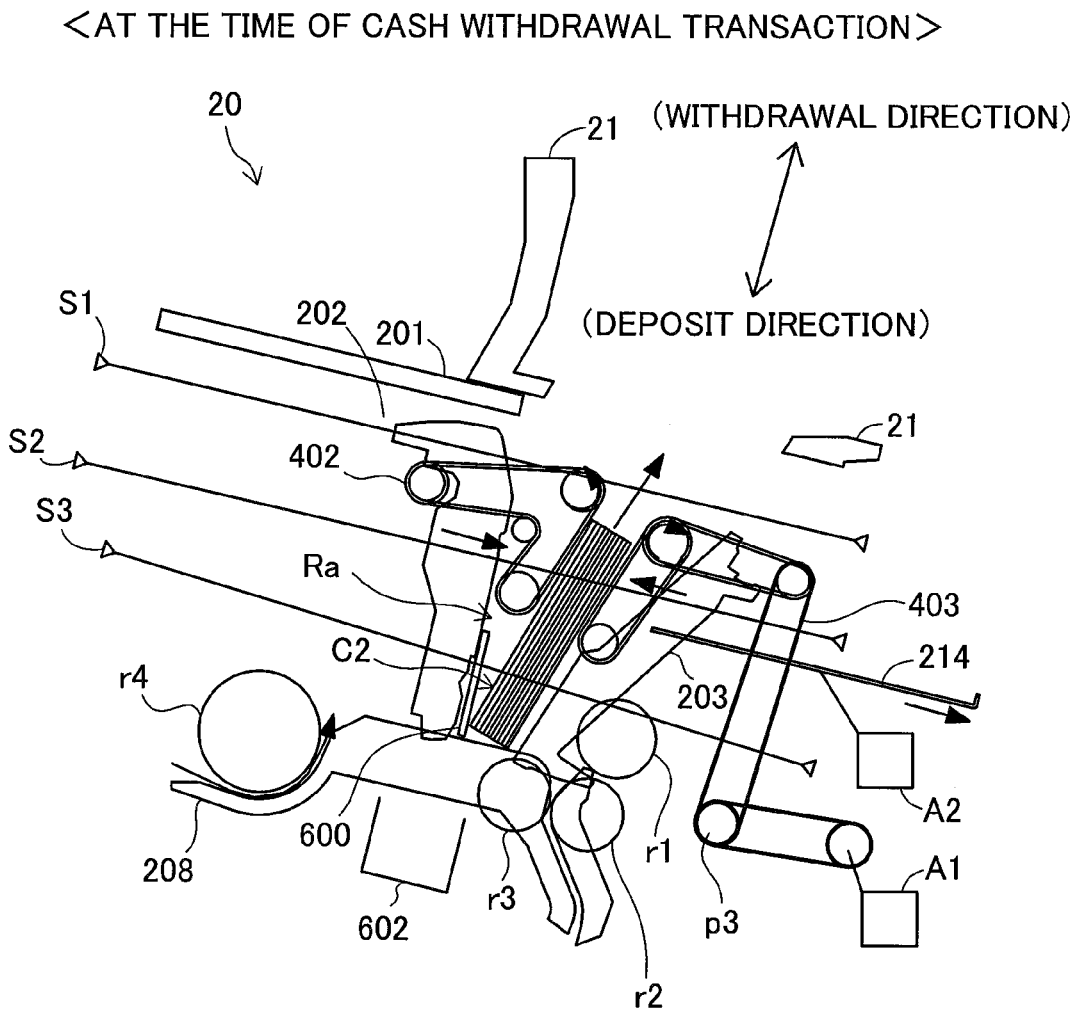
FIG. 11 is an explanatory diagram showing the state of the cash deposit/withdrawal mechanism immediately after execution of step 5235.

FIG. 11 is an explanatory diagram showing the state of the cash deposit/withdrawal mechanism 20 immediately after execution of step S235. In this state, the front clamping mechanism 403 and the rear clamping mechanism 402 are set at the discharge positions as shown in FIG. 11. At the discharge positions, the front clamping mechanism 403 is protruded inward (toward bills C2) from the front push plate 203, while the rear clamping mechanism 402 is protruded inward from the rear push plate 202 to clamp the bills C2 accumulated in the bill accumulation area Ra. Until part of the bills C2 is exposed on the cash slot 21, the clamp belts for bill conveyance in the front clamping mechanism 403 and in the rear clamping mechanism 402 are continuously driven in the delivery direction. This arrangement enables the user to smoothly take out the bills without inserting the hand or fingers into the bill accumulation area Ra.

Referring back to the flowchart of FIG. 10, the deposit/withdrawal controller 328 stops the clamp belts in the pair of clamping mechanisms 402 and 403 (step S245). The deposit/withdrawal controller 328 then determines whether the user has completed the withdrawal of bills based on the output of the sensor S1 and waits for completion of the withdrawal of bills (step S250). On completion of the withdrawal of bills, the light is not shielded, and the output of the light-receiving element is changed in the sensor S1. The deposit/withdrawal controller 328 can thus determine completion of the withdrawal of bills, based on a change of the output of the light-receiving element in the sensor S1. When it is determined that the user has completed the withdrawal of bills, the deposit/withdrawal controller 328 closes the shutter 201 (step S255).

As described above, in the automated teller machine 500 of the first embodiment, at the time of a cash deposit transaction, the pair of clamping mechanisms 402 and 403 move in the mutually approaching directions and are located between the pair of push plates 202 and 203 to clamp the inserted bills and convey the bills into the automated teller machine 500. This arrangement enables the user to smoothly deposit the bills without inserting the hand or fingers into the bill accumulation area Ra. At the time of a cash withdrawal transaction, the pair of clamping mechanisms 402 and 403 move in the mutually approaching directions and are located outside the pair of push plates 202 and 203 to hold the bills and convey the bills until part of the bills are exposed on the cash slot 21. This arrangement enables the user to smoothly take out the bills without inserting the hand or fingers into the bill accumulation area Ra.

When the inserted bills are fed into the bill conveyor path, the front clamping mechanism 403 is retreated outward from the front push plate 203 (that is, on the opposite side of the bills across the front push plate 203). Such positioning causes the bills to come into contact with only the front push plate 203 and prevents the bundle of bills from being bent or folded. This arrangement thus effectively prevents the occurrence of any bill jam when the bundle of bills is fed from the bill accumulation area Ra into the bill conveyor path. The pair of clamping mechanisms 402 and 403 are provided to allow the overlapping arrangement with the pair of push plates 202 and 203. This arrangement desirably shortens the depth of the bill accumulation area Ra (that is, the length in the deposit/withdrawal directions) and reduces the size of the cash deposit/withdrawal mechanism 20.

At the time of a cash deposit transaction, the clamp belts in the pair of clamping mechanism 402 and 403 come into contact with each other at the positions of the pulleys on the lower ends to be arranged in a V shape. This arrangement gives the user the bill-bumping feeling and allows the user to release the inserted bills with a sense of security. The inserted bundle of bills is bumped between the clamp belts in the pair of clamping mechanisms 402 and 403. This arrangement effectively eliminates the inclination of the bills at least in the inserting direction and enables the bundle of bills to be aligned in the bill accumulation area Ra. The V-shaped arrangement of the pair of clamping mechanisms 402 and 403 assures a relatively wide space between the pair of clamping mechanisms 402 and 403 at the position closer to the cash slot 21. In the case of insertion of a lot of bills, the user can thus readily insert the bundle of bills into the cash slot 21. The clamp belts in the pair of clamping mechanisms 402 and 403 hold the central part of the bills in the width direction. The both ends of the bundle of bills are accordingly located in a relatively wide space defined by the pair of push plates 202 and 203. Even when the bundle of bills has a relatively large thickness and the spread ends, the user can readily deposit the bills.

B. Second Embodiment

Figure 12:
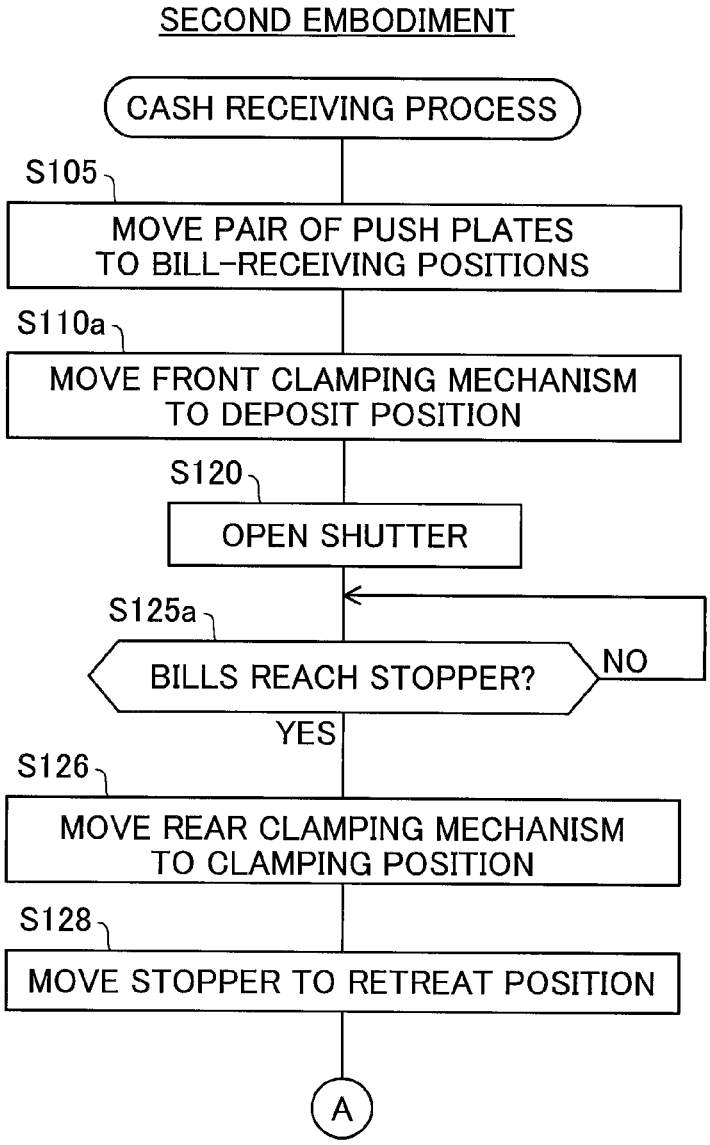
FIG. 12 is a flowchart showing a first part of a cash receiving process executed in a second embodiment in accordance with the invention.
Figure 13:
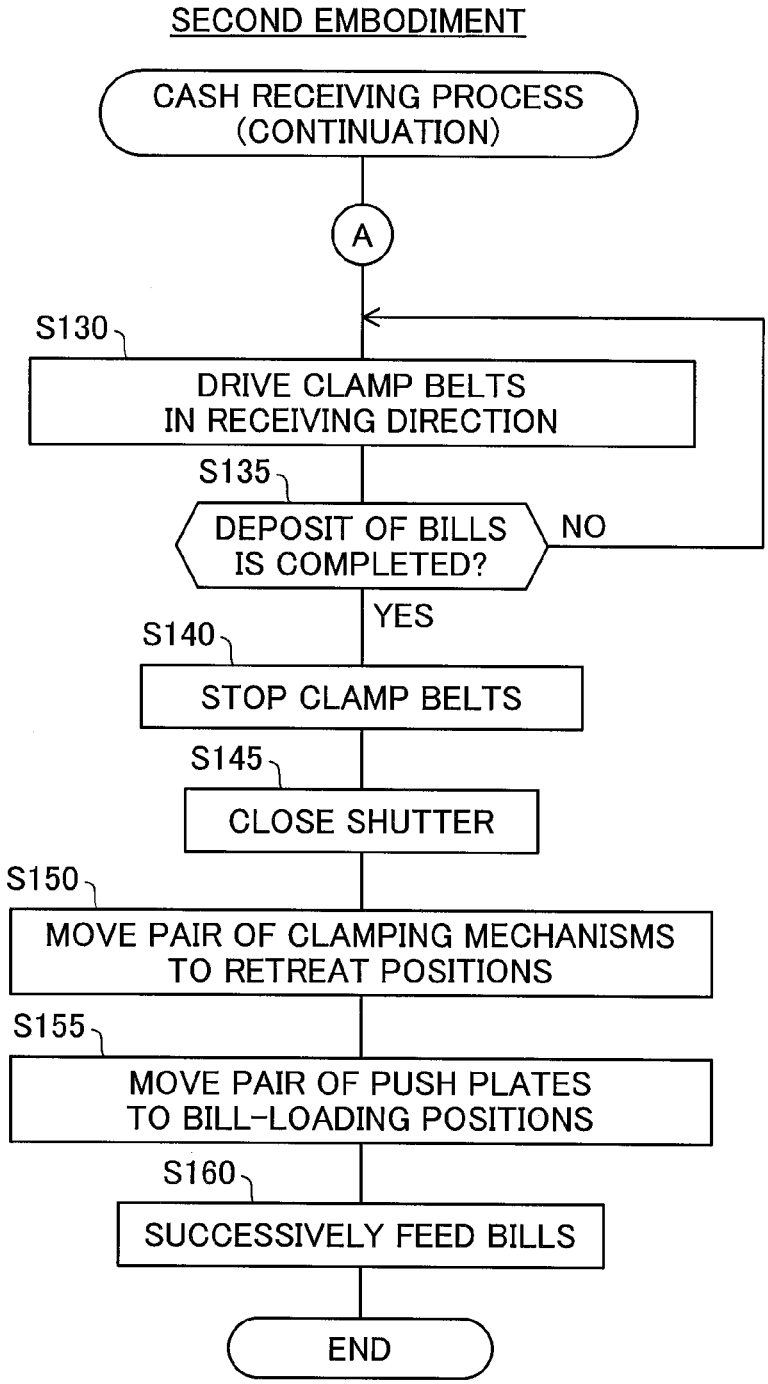
FIG. 13 is a flowchart showing a second part of the cash receiving process executed in the second embodiment.

FIG. 12 is a flowchart showing a first part of a cash receiving process executed in a second embodiment in accordance with the invention. FIG. 13 is a flowchart showing a second part of the cash receiving process executed in the second embodiment.

An automated teller machine of the second embodiment has the similar configuration to that of the automated teller machine 500 of the first embodiment shown in FIG. 1, except execution of steps S110*a* in place of step S110, omission of step S115, execution of step S125*a* in place of step S125, and addition of steps S126 and S128 in the cash receiving process.

In the automated teller machine of the second embodiment, the pair of clamping mechanisms 402 and 403 do not come into contact with each other in the state of insertion of bills into the cash slot 21, and the stopper 214 is exposed on the bill accumulation area Ra.

Unlike the procedure of the first embodiment, after execution of step S105, the deposit/withdrawal controller 328 moves only the front clamping mechanism 403 to the deposit position (step S110*a*), while keeping the rear clamping mechanism 402 at the retreat position. The pair of clamping mechanisms 402 and 403 are thus not in contact with each other but are apart from each other across a relatively wide space. The deposit/withdrawal controller 328 then opens the shutter 201 (step S120).

Unlike the first embodiment, in this state, the stopper 214 is kept at the bill-receiving position to be located between the pair of clamping mechanisms 402 and 403. The position of the stopper 214 is determined, such that the distance between the cash slot 21 and the stopper 214 is shorter than the length of each inserted bill in the height direction. This arrangement enables the user to hit bills against the stopper 214 without inserting the hand or fingers into the bill accumulation area Ra. At the time of insertion of bills, there is a relatively large space between the front clamping mechanism 403 and the rear clamping mechanism 402. This arrangement enables the user to readily insert the bundle of bills into the cash slot 21.

The deposit/withdrawal controller 328 determines whether the bills have reached the stopper 214 based on the output of the sensor S2 and waits for the reach of bills to the stopper 214 (step S125*a*). When the bills have reached the stopper 214, the light is shielded in the sensor S2. The deposit/withdrawal controller 328 can thus determine whether the bills have reached the stopper 214, based on a change of the output of the light-receiving element in the sensor S2. On determination of the reach of the bills to the stopper 214, the deposit/withdrawal controller 328 moves the rear clamping mechanism 402 to the clamping position (step S126).

Figure 14:
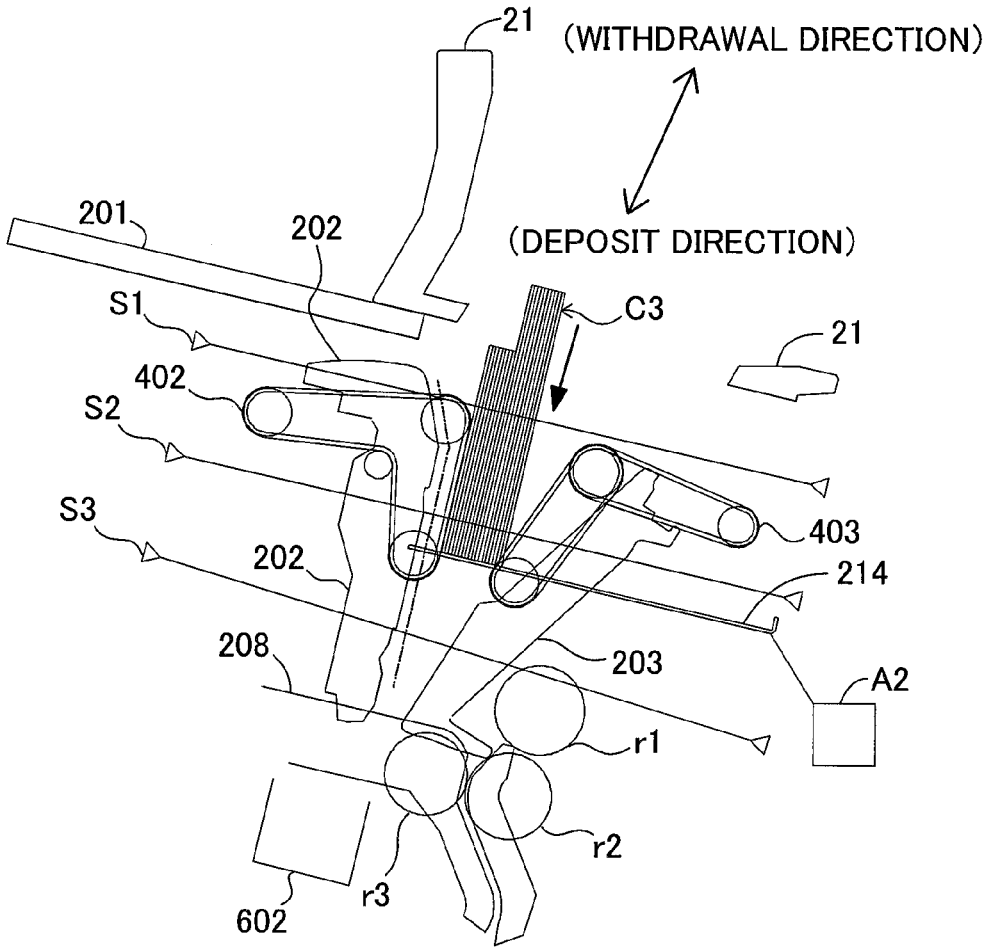
FIG. 14 is an explanatory diagram showing the state of the cash deposit/withdrawal mechanism after execution of step S126 in the second embodiment.

FIG. 14 is an explanatory diagram showing the state of the cash deposit/withdrawal mechanism after execution of step S126 in the second embodiment. For the convenience of illustration, some constituents including the stack roller r4 are omitted from the illustration of FIG. 14. As shown in FIG. 14, the bottom of a bundle of bills C3 is hit against the stopper 214. This eliminates misalignment of the bundle of bills C3 in the inserting direction. The lower end of the bundle of bills C3 is clamped between the front clamping mechanism 403 and the rear clamping mechanism 402.

Referring back to the flowchart of FIG. 12, the deposit/withdrawal controller 328 then moves the stopper 214 to the retreat position (step S128). In this state, the bundle of bills C3 is clamped by the pair of clamping mechanisms 402 and 403 and does not fall toward the bottom plate 208. The deposit/withdrawal controller 328 subsequently performs the processing of steps S130 through S160 in the flowchart of FIG. 13, which are identical with steps S130 through S160 of the first embodiment shown in the flowchart of FIG. 7 and are thus not specifically explained here.

The automated teller machine of the second embodiment having the configuration discussed above has the similar effects to those of the automated teller machine 500 of the first embodiment. At the time of insertion of bills, the rear clamping mechanism 402 is set at the retreat position, so that there is a relatively wide space between the front clamping mechanism 403 and the rear clamping mechanism 402. This arrangement enables the user to readily insert even a relatively thick bundle of bills into the cash slot 21.

C. Third Embodiment

Figure 15:
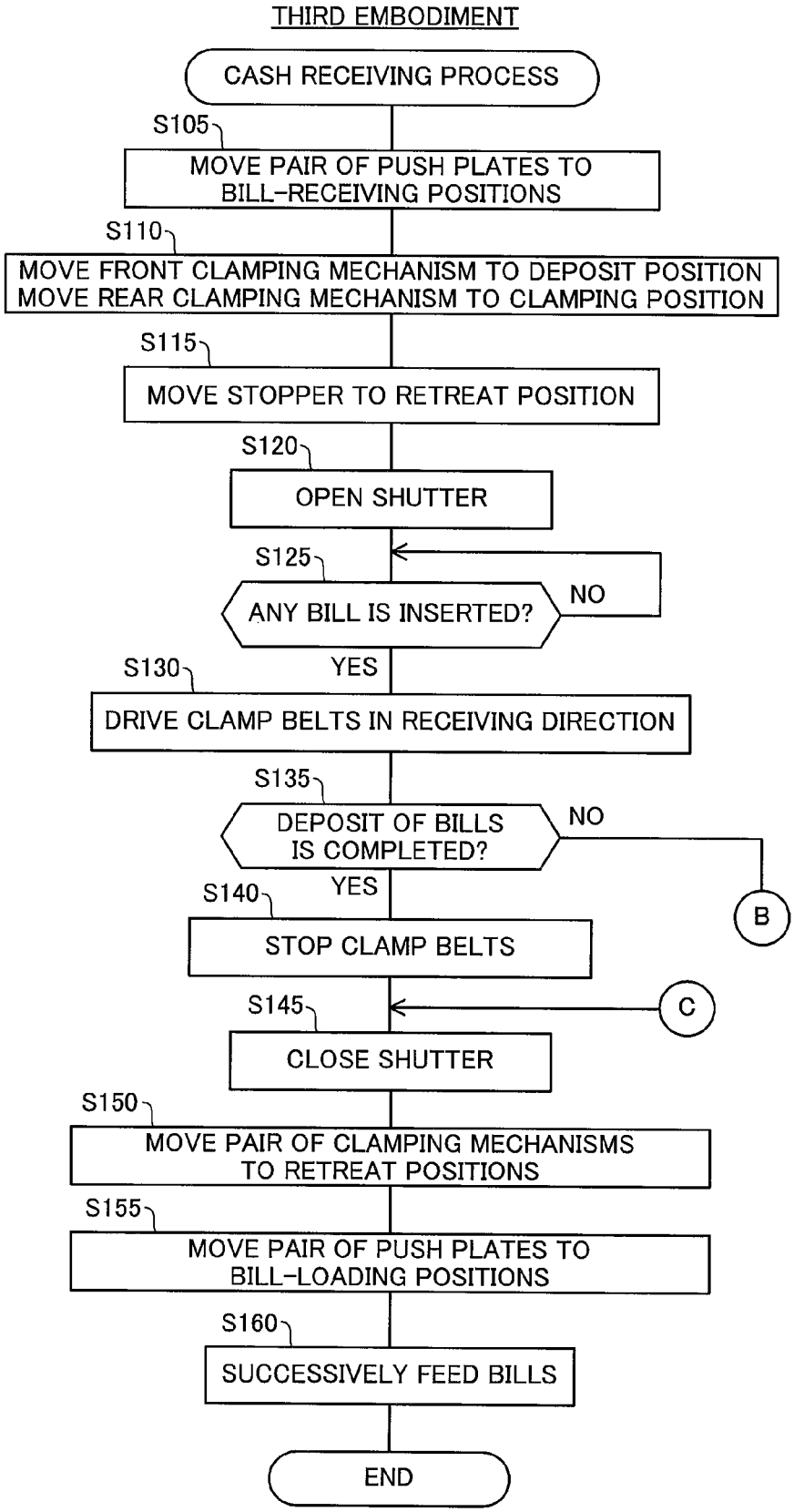
FIG. 15 is a flowchart showing a first part of a cash receiving process executed in a third embodiment in accordance with the invention.
Figure 16:
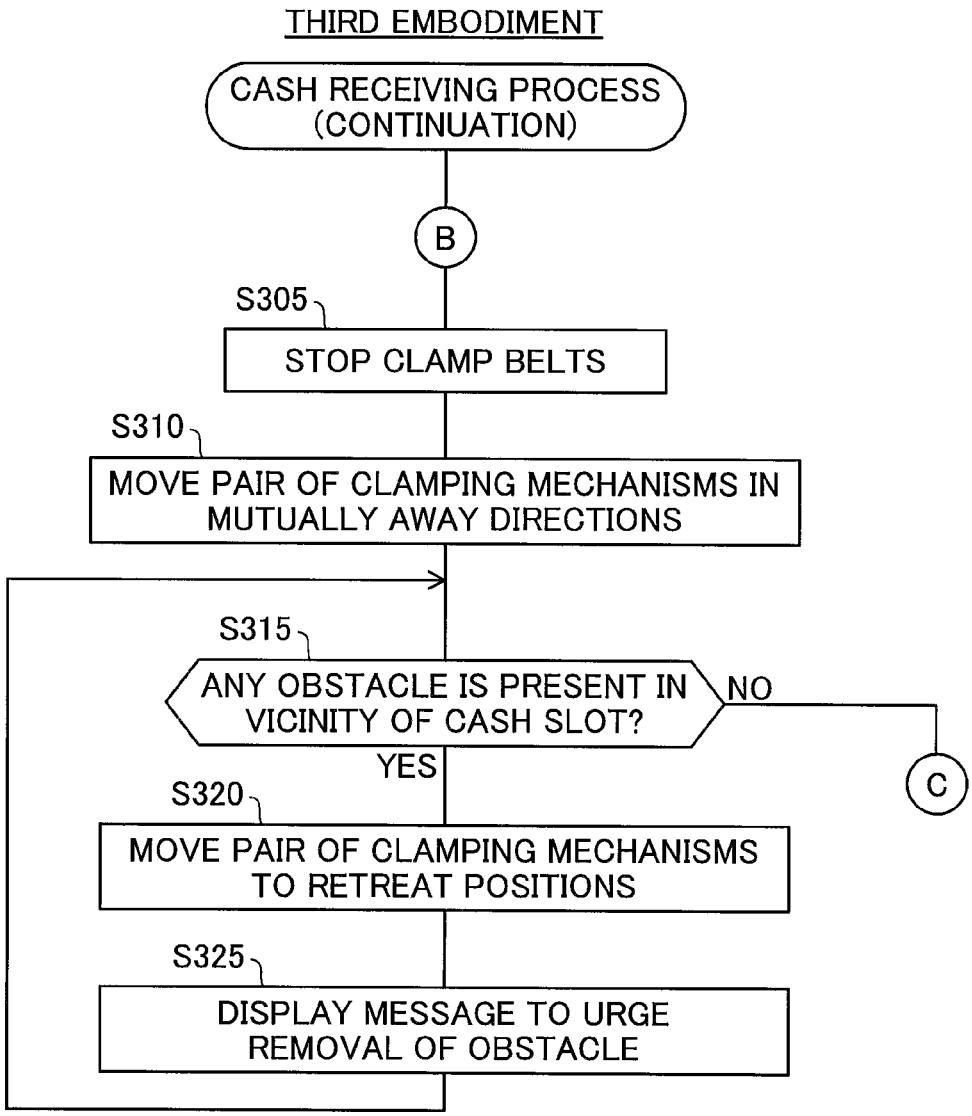
FIG. 16 is a flowchart showing a second part of the cash receiving process executed in the third embodiment.
Figure 17:
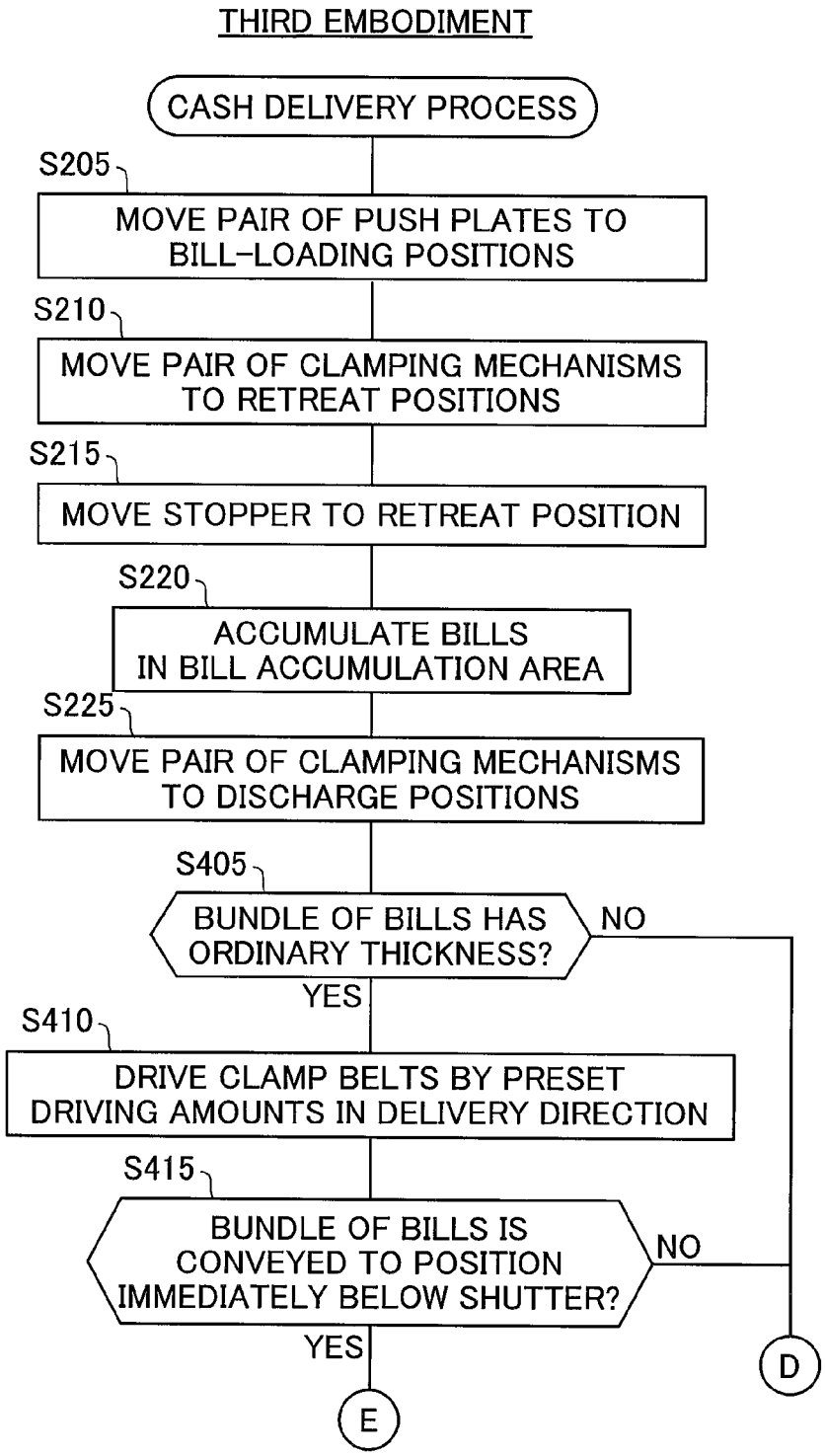
FIG. 17 is a flowchart showing a first part of a cash delivery process executed in the third embodiment.
Figure 18:
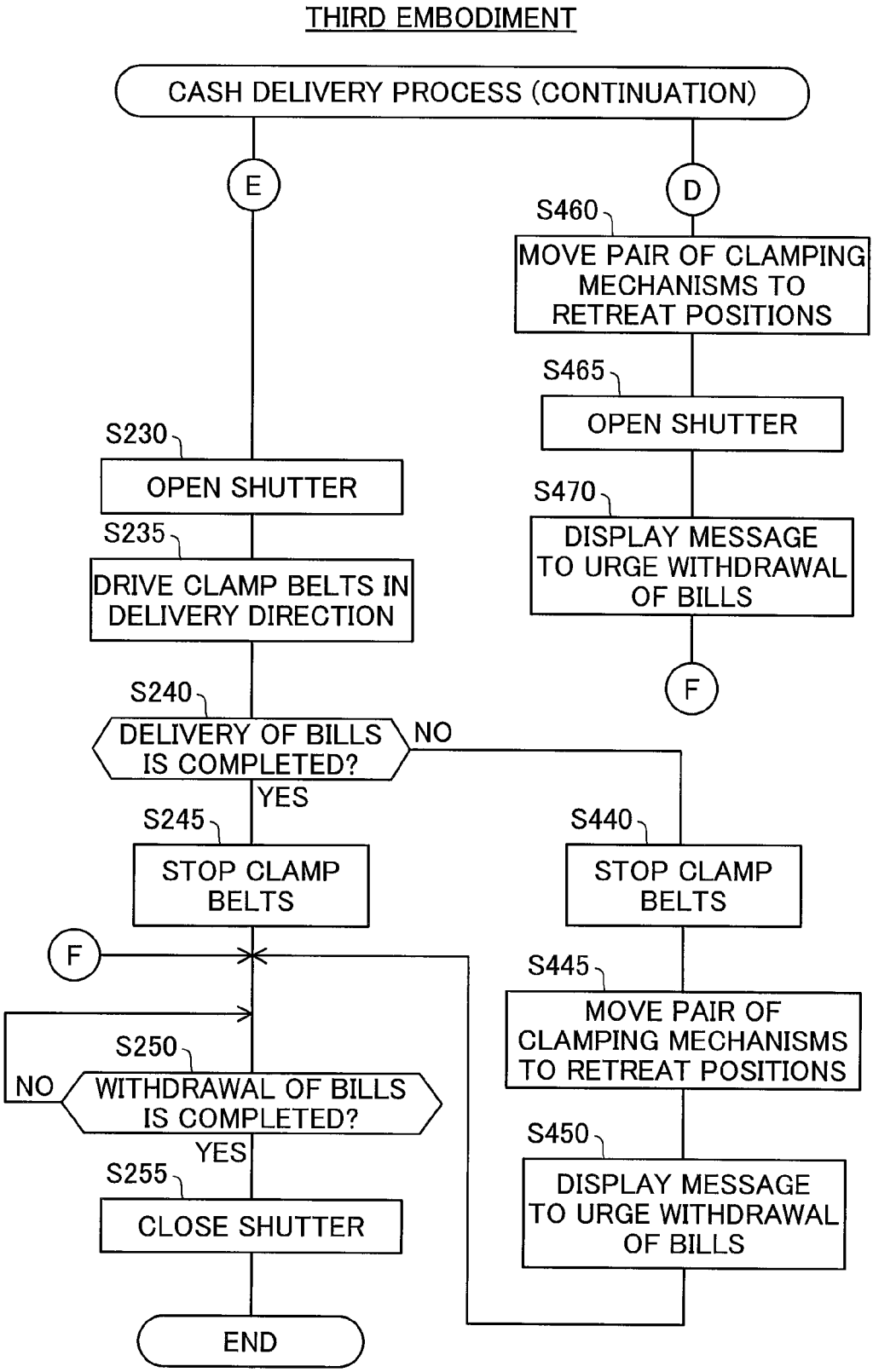
FIG. 18 is a flowchart showing a second part of the cash delivery process executed in the third embodiment.

FIG. 15 is a flowchart showing a first part of a cash receiving process executed in a third embodiment in accordance with the invention. FIG. 16 is a flowchart showing a second part of the cash receiving process executed in the third embodiment. FIG. 17 is a flowchart showing a first part of a cash delivery process executed in the third embodiment. FIG. 18 is a flowchart showing a second part of the cash delivery process executed in the third embodiment.

An automated teller machine of the third embodiment has the similar configuration to that of the automated teller machine 500 of the first embodiment shown in FIG. 1, except addition of steps S305 through S325 in the cash receiving process and addition of steps S405 through S470 in the cash delivery process.

The automated teller machine of the third embodiment detects the conditions in conveyance of a bundle of bills (for example, the thickness of the bundle of bills and the presence or the absence of the remaining bundle of bills) and determines the possibility or impossibility for successful conveyance of the bundle of bills clamped by means of the pair of clamping mechanisms 402 and 403. In the case of impossible conveyance, the bills are released from the pair of clamping mechanisms 402 and 403 and remain in the bill accumulation area Ra.

The cash receiving process of the third embodiment is described below. The deposit/withdrawal controller 328 first performs the processing of steps S105 through S130 shown in the flowchart of FIG. 15, which are identical with steps S105 through S130 of the first embodiment shown in the flowchart of FIG. 7 and are thus not specifically explained here. At the time of execution of step S135 described below, bills (bundle of bills) inserted via the cash slot 21 are clamped by the pair of clamping mechanisms 402 and 403.

After execution of step S130, the deposit/withdrawal controller 328 determines whether the deposit of bills into the bill accumulation area Ra has been completed, based on the outputs of the two sensors S1 and S3 (step S135). Unlike the procedure of the first embodiment, however, the deposit/withdrawal controller 328 determines whether the deposit of bills has been completed in a preset time period. When it is determined at step S135 that the deposit of bills has been completed in the preset time period, the deposit/withdrawal controller 328 performs the processing of steps S140 through S160 shown in the flowchart of FIG. 15, which are identical with steps S140 through S160 of the first embodiment shown in the flowchart of FIG. 7 and are thus not specifically explained here. The time period may be set in advance experimentally or otherwise as a time period required between detection of insertion of a bundle of bills and normal conveyance of the bundle of bills toward the bottom plate 208.

When it is determined at step S135 that the deposit of bills has not been completed in the preset time period, the program proceeds to step S305 in the flowchart of FIG. 16. At step S305, the deposit/withdrawal controller 328 stops the clamp belts in the pair of clamping mechanisms 402 and 403. The determination of the uncompleted deposit of bills in the preset time period may be made, for example, when the inserted bundle of bills has a significant thickness and remains in the cash slot 21 and causes the light to be shielded in the sensor S1. The determination may also be made, when the user inserts the hand or fingers into a detection line of the sensor S1 and causes the light to be shielded in the sensor S1.

The deposit/withdrawal controller 328 then moves the pair of clamping mechanisms 402 and 403 by preset distances in the mutually away directions (step S310). In one modification, the procedure may move the pair of clamping mechanisms 402 and 403 to preset positions. In another modification, the procedure may move only one of the two clamping mechanism 402 and 403 in the direction away from the other. After execution of step S310, the bundle of bills is released from the pair of clamping mechanism 402 and 403 and falls in the bill accumulation area Ra toward the bottom plate 208.

The deposit/withdrawal controller 328 detects the presence of any obstacle in the vicinity of the cash slot 21, based on the output of the sensor S1 (step S315). The bundle of bills is located in a lower area of the bill accumulation area Ra as the result of step S310. In the absence of any obstacle in the vicinity of the cash slot 21, the light is not shielded in the sensor S1. In the presence of any obstacle in the vicinity of the cash slot 21, on the other hand, the light is shielded in the sensor S1. The obstacle may be, for example, the user's hand or fingers or the bundle of bills that is not released by the pair of clamping mechanisms 402 and 403 and remains in the vicinity of the cash slot 21.

On detection of any obstacle in the vicinity of the cash slot 21 at step S315, the deposit/withdrawal controller 328 moves the pair of clamping mechanisms 402 and 403 to the retreat positions (step S320). The operation controller 327 (FIG. 3) then shows a message to urge removal of the obstacle on a display (not shown) of the operation control unit 105 (step S325). After execution of step S325, the program returns to step S315. The deposit/withdrawal controller 328 again detects the presence of any obstacle at step S315. When the obstacle detected at step S315 is the user's hand or fingers, the user reading the message is expected to draw back the hand or fingers from the cash slot 21.

On detection of no obstacle in the vicinity of the cash slot 21 at step S315, on the other hand, the deposit/withdrawal controller 328 performs the processing of steps S145 through S160 in the flowchart of FIG. 15. After removal of the bundle of bills remaining in the vicinity of the cash slot 21, the bills are neither accumulated in the bill accumulation area Ra nor fed into the bill conveyor path at step S160 (FIG. 15). In this case, the user is allowed to operate the customer operation unit 105 again for selection of a cash deposit transaction option and deposit bills.

The cash delivery process of the third embodiment is described below. The deposit/withdrawal controller 328 first performs the processing of steps S205 through S225 shown in the flowchart of FIG. 17, which are identical with steps S205 through S225 of the first embodiment shown in the flowchart of FIG. 10 and are thus not specifically explained here. At the time of execution of step S405 described below, bills (bundle of bills) accumulated in the bill accumulation area Ra are clamped by the pair of clamping mechanisms 402 and 403.

After execution of step S225, the deposit/withdrawal controller 328 detects the thickness of the bundle of bills clamped by the pair of clamping mechanisms 402 and 403 and determines whether the bundle of bills has an ordinary thickness (step S405). The thickness of the bundle of bills may be detected, for example, by the moving distance of the rear clamping mechanism 402. One concrete procedure experimentally or otherwise sets in advance a relation between the sliding amount of the front clamping mechanism 403 and the thickness of the bundle of bills and stores the specifies relation as a map in the memory 312 (FIG. 3). The deposit/withdrawal controller 328 measures the sliding amount of the front clamping mechanism 403 moved at step S225 and refers to the stored map to read the thickness of the bundle of bills corresponding to the measured sliding amount. A threshold value is set in advance for the sliding amount. The deposit/withdrawal controller 328 determines that the bundle of bills has an extraordinary thickness when the measured sliding amount is less than the preset threshold value.

When it is determined at step S405 that the bundle of bills has an ordinary thickness, the deposit/withdrawal controller 328 drives the clamp belts in the pair of clamping mechanisms 402 and 403 by preset driving amounts in the delivery direction and stops the clamp belts (step S410). The preset driving amounts cause one end of the bundle of bills (the end closer to the shutter 201) to be located at a position higher than the detection line of the sensor S1 immediately below the shutter 201 in the case of conveyance of the bundle of bills in the normal condition (without the occurrence of any bill jam). The driving amounts may be experimentally or otherwise set in advance.

The deposit/withdrawal controller 328 then determines whether the bundle of bills has been successfully conveyed to the position immediately below the shutter 201, based on the output of the sensor S1 (step S415).

Figure 19:
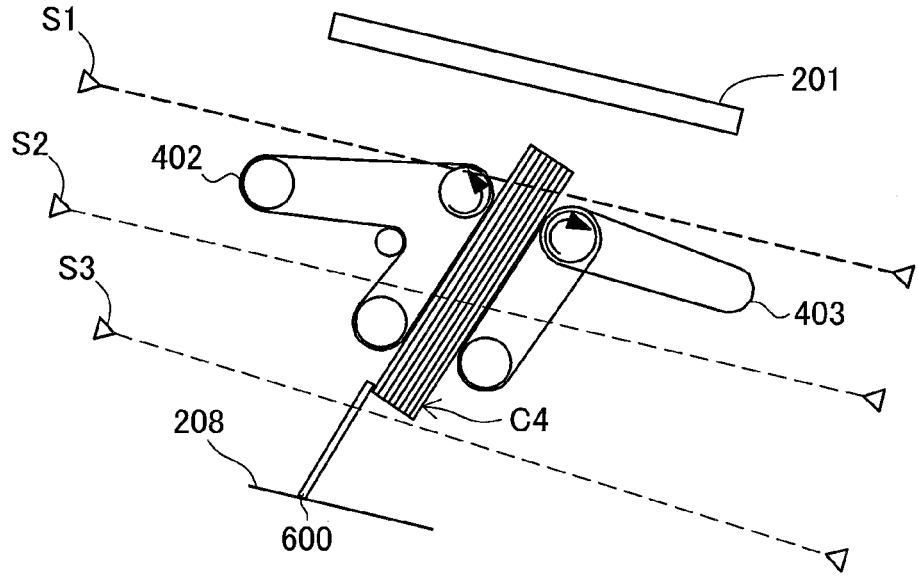
FIG. 19 is explanatory diagrams schematically showing the states of a bundle of bills after driving the clamp belts by the preset driving amounts at step S415.
Figure 19:
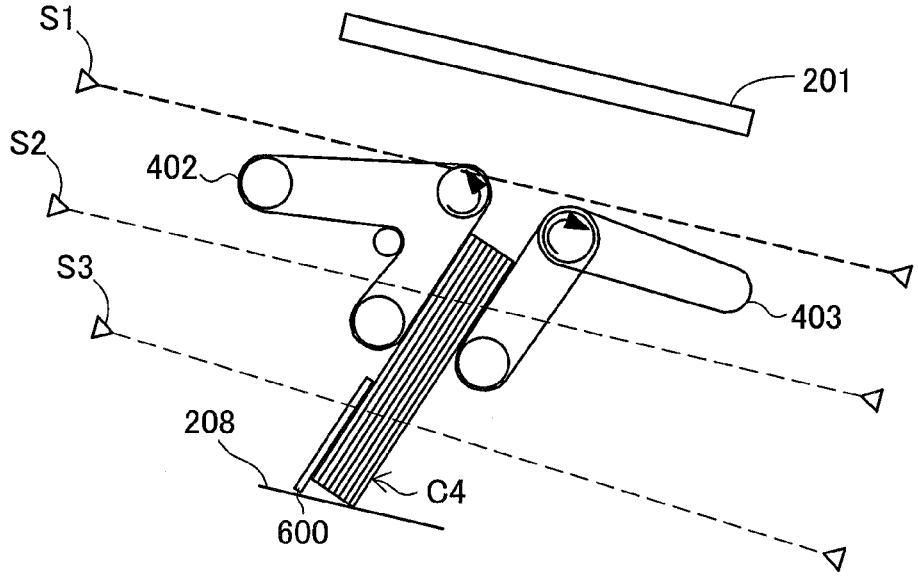

FIG. 19 is explanatory diagrams schematically showing the states of a bundle of bills C4 after driving the clamp belts by the preset driving amounts at step S415. The upper diagram of FIG. 19 shows the state of successful conveyance of the bundle of bills C4 to the position immediately below the shutter 201. The lower diagram of FIG. 19 shows the state of failed conveyance of the bundle of bills C4.

In the case of successful conveyance of the bundle of bills C4 to the position immediately below the shutter 201, the end of the bundle of bills C4 is located above the detection line of the sensor S1 as shown by the upper diagram of FIG. 19. In this state, the light is shielded in the sensor S1. The deposit/withdrawal controller 328 can thus determine that the bundle of bills has been successfully conveyed to the position immediately below the shutter 201, based on the output of the sensor S1. In the case of failed conveyance of the bundle of bills C4 to the position immediately below the shutter 201, on the other hand, the end of the bundle of bills C4 is located below the detection line of the sensor S1 as shown by the lower diagram of FIG. 19. In this state, the light is not shielded in the sensor S1. The deposit/withdrawal controller 328 can thus determine that the bundle of bills has not been successfully conveyed to the position immediately below the shutter 201, based on the output of the sensor S1. Namely the deposit/withdrawal controller 328 executes the processing of steps S410 and S415 to determine the possibility or impossibility for successful conveyance of the bundle of bills.

The successful conveyance of the bundle of bills to the position immediately below the shutter 201 may be determined, based on the output of the sensor S3 in combination with or in place of the output of the sensor S1. In the case of successful conveyance of the bundle of bills, the light is not shielded in the sensor S3. In the case of failed conveyance of the bundle of bills, on the other hand, the light is shielded in the sensor S3. The deposit/withdrawal controller 328 can thus determine whether the bundle of bills have been successfully conveyed to the position immediately below the shutter 210, based on the output of the sensor S3.

Referring back to the flowchart of FIG. 17, when it is determined at step S415 that the bundle of bills has been conveyed to the position immediately below the shutter 201, the deposit/withdrawal controller 328 performs the processing of steps S230 through S255 shown in the flowchart of FIG. 18, which are identical with steps S230 through S255 of the first embodiment shown in the flowchart of FIG. 10 and are thus not specifically explained here. The processing in response to a negative answer of step S240 'uncompleted delivery of bills' is, however, different from the procedure of the first embodiment as explained below.

With referring to the flowchart of FIG. 18, upon determination of the uncompleted delivery of bills at step S240, the deposit/withdrawal controller 328 stops the clamp belts in the pair of clamping mechanisms 402 and 403 (step S440) and moves the pair of clamping mechanisms 402 and 403 to the retreat positions (step S445). The operation controller 327 (FIG. 3) then shows a message to urge withdrawal of bills on the display (not shown) of the customer operation unit 105 (step S450).

The determination of the uncompleted delivery of bills may be made, for example, when a bill is stuck in some place of the cash deposit/withdrawal mechanism 20 during conveyance of the bills by the pair of clamping mechanisms 402 and 403. In this case, the user reading the message displayed on the customer operation unit 105 is expected to take out the bundle of bills accumulated in the bill accumulation area Ra. Since the pair of clamping mechanisms 402 and 403 are set at the retreat positions, a relatively wide space is ensured for the bill accumulation area Ra. The user can thus readily insert the hand or fingers into the bill accumulation area Ra to take out the bundle of bills.

After execution of step S450, the deposit/withdrawal controller 328 performs the processing of and after step S250.

Upon determination of the extraordinary thickness of the bundle of bills at step S405 (FIG. 17) or upon determination of the failed conveyance of the bundle of bills to the position immediately below the shutter 201 at step S415 (FIG. 17), the deposit/withdrawal controller 328 moves the pair of clamping mechanisms 402 and 403 to the retreat position at step S460 (FIG. 18). The bundle of bills is then released from the pair of clamping mechanisms 402 and 403. In the case where a lot of bills are conveyed by means of the pair of clamping mechanisms 402 and 403, part of the bills may be dropped off to be not conveyed or some bills may be hit against some place in the bill accumulation area Ra to be folded or bent. The bundle of bills having a large thickness is thus released from the pair of clamping mechanisms 402 and 403 and is not conveyed by means of the pair of clamping mechanisms 402 and 403. The pair of clamping mechanisms 402 and 403 are retreated to the positions outside the pair of push plates 202 and 203 at step S460. A relatively wide space is thus ensured for the bill accumulation area Ra.

The deposit/withdrawal controller 328 subsequently opens the shutter 201 (step S465). The operation controller 327 (FIG. 3) then shows a message to urge withdrawal of bills on the display (not shown) of the customer operation unit 105 (step S470). As mentioned above, since a relatively wide space is ensured for the bill accumulation area Ra, the user can readily take out the bundle of bills from the bill accumulation area Ra. Even when a bill is stuck at any place in the bill accumulation area Ra, the user can readily remove the bill.

After execution of step S470, the deposit/withdrawal controller 328 performs the processing of and after step S250.

The automated teller machine of the third embodiment having the configuration discussed above has the similar effects to those of the automated teller machine 500 of the first embodiment. At the time of a cash deposit transaction, in the case of uncompleted deposit of bills in the preset time period, the bundle of bills is released from the pair of clamping mechanisms 402 and 403. Even when the inserted bundle of bills remains in the vicinity of the cash slot 21 due to, for example, a large thickness of the bundle of bills, this arrangement enables the bills to be accumulated in the bill accumulation area Ra. At the time of a cash withdrawal transaction, when the bundle of bills to be delivered has a large thickness, the bundle of bills is not conveyed by means of the pair of clamping mechanisms 402 and 403 but is kept in the bill accumulation area Ra. This arrangement effectively prevents the bills from being folded or bent during conveyance by means of the pair of clamping mechanisms 402 and 403. In this state, the pair of clamping mechanisms 402 and 403 are located outside the pair of push plates 202 and 203. A relatively wide space is thus ensured for the bill accumulation area Ra and enables the user to readily take out the bundle of bills from the bill accumulation area Ra.

D. Modified Examples

Among the various components included in the structures of the embodiments discussed above, the components other than those disclosed in independent claims are additional elements and may be omitted according to the requirements. The embodiments and their applications discussed above are to be considered in all aspects as illustrative and not restrictive. There may be many modifications, changes, and alterations without departing from the scope or spirit of the main characteristics of the present invention. Some examples of possible modification are given below.

D1. Modified Example 1

In the structures of the above embodiments, the pair of clamping mechanisms 402 and 403 are provided to have the overlapping arrangement with the pair of push plates 202 and 203 as shown in FIG. 4A and FIG. 4B. In one modified structure, the pair of clamping mechanisms 402 and 403 may be provided to have no overlapping arrangement with the pair of push plates 202 and 203.

Figure 20:
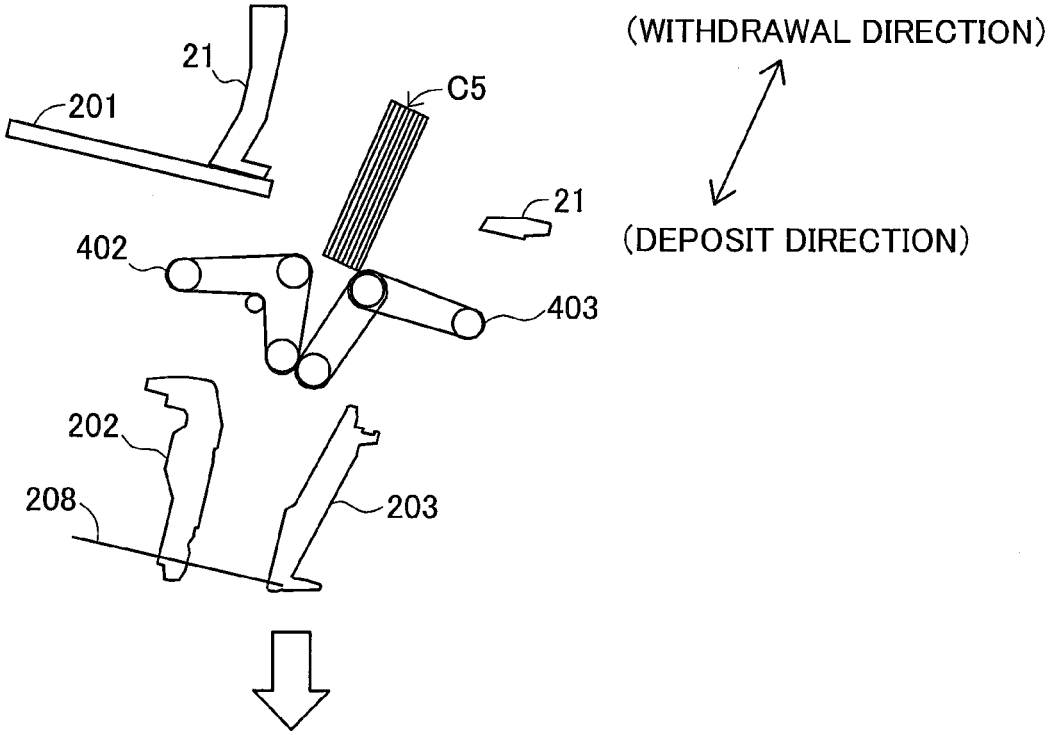
FIG. 20 is explanatory diagrams schematically showing the states of a cash deposit/withdrawal mechanism in Modified Example 1.
Figure 20:
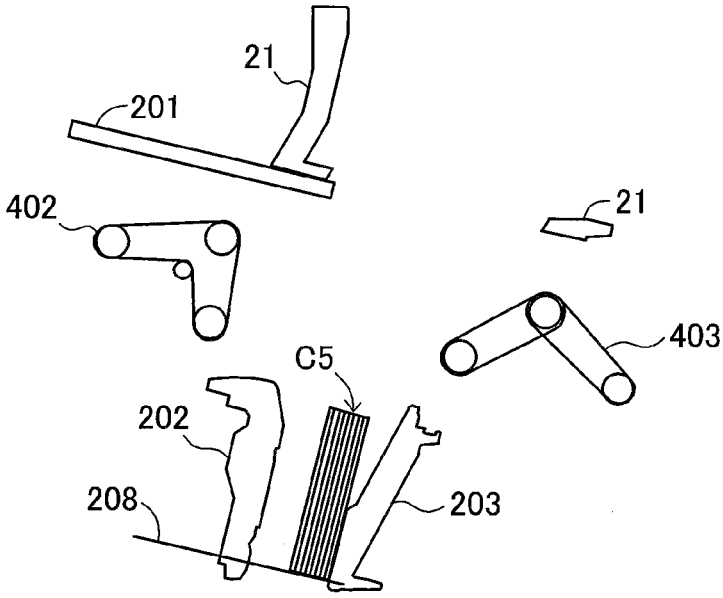

FIG. 20 is explanatory diagrams schematically showing the states of a cash deposit/withdrawal mechanism in Modified Example 1. The upper diagram of FIG. 20 shows the state of the cash deposit/withdrawal mechanism at the time of insertion of bills. The lower diagram of FIG. 20 shows the state of the cash deposit/withdrawal mechanism at the time of feeding the inserted bills into the bill conveyor path. The cash deposit/withdrawal mechanism of Modified Example 1 has the similar structure to that of the cash deposit/withdrawal mechanism 20 of the first embodiment, except that the pair of clamping mechanisms 402 and 403 are provided to have no overlapping arrangement with the pair of push plates 202 and 203. For the convenience of explanation, part of the constituents of the cash deposit/withdrawal mechanism including the three sensors S1 through S3 and the pick roller r1 are omitted from the illustration of FIG. 20.

The pair of clamping mechanisms 402 and 403 are located above the pair of push plates 202 and 203 (on the side closer to the cash slot 21) and accordingly do not have the overlapping arrangement with the pair of push plates 202 and 203. Like the first embodiment discussed above, the pair of clamping mechanisms 402 and 403 are arranged in a V shape at the time of insertion of bills (for example, at step S125 in FIG. 7). The pair of clamping mechanisms 402 and 403 are located inside the pair of push plates 202 and 203, seen from the cash slot 21. The pair of clamping mechanisms 402 and 403 accordingly clamp a bundle of bills C5 inserted at the time of bill insertion.

At the time of feeding the bills (step S160 in the flowchart of FIG. 7), the pair of clamping mechanisms 402 and 403 have been moved in the mutually away directions, compared with the positions at the time of insertion of the bills. In this state, the pair of clamping mechanisms 402 and 403 are located outside the pair of push plates 202 and 203, seen from the cash slot 21. The bundle of bills C5 is located between the pair of push plates 202 and 203. The processing of step S160 is executed to make the bills successively pass between the separation roller r2 and the gate roller r3 and fed into the bill conveyor path.

The automated teller machine of the modified example with the cash deposit/withdrawal mechanism of this structure has the similar effects to those of the automated teller machine 500 of the first embodiment. In general, the configuration of arranging the pair of conveyor assemblies at any position between inside and outside the pair of plate members, seen from the paper sheet slot, is applicable to the paper sheet handling machine of the invention.

D2. Modified Example 2

The bases for the determination of successful conveyance or failed conveyance of bills in the third embodiment are the thickness of the bundle of bills and the presence or the absence of the remaining bundle of bills. The technique of the present invention is, however, not restricted to these bases. The determination of successful conveyance or failed conveyance of bills may be based on, for example, the inclination of bills or a positional misalignment of bills in the width direction.

Figure 21A:
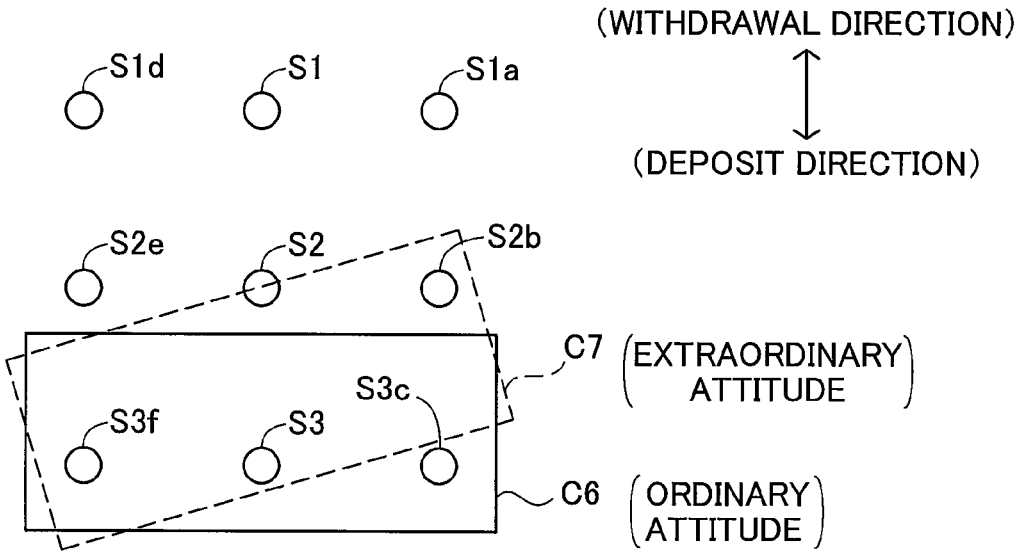
FIGS. 21A and 21B are an explanatory diagram schematically showing a sensor arrangement in an automated teller machine of a first application in Modified Example 2, and an explanatory diagram schematically showing a sensor arrangement in an automated teller machine of a second application in Modified Example 2.

FIG. 21A is an explanatory diagram schematically showing a sensor arrangement in an automated teller machine of a first application in Modified Example 2. The automated teller machine of the first application in Modified Example 2 has the similar configuration to that of the automated teller machine 500 of the first embodiment shown in FIG. 1, except the use of six sensors S1*a* through S3*f* in addition to the three sensors S1 through S3 explained previously.

In the first application of Modified Example 2, a column of sensors S1*a*, S2*b*, and S3*c* and a column of sensors S1*d*, S2*e*, and S3*f* are arranged in parallel to the column of sensors S1, S2, and S3 discussed above. The distance between the column of sensors S1*a*, S2*b*, and S3*c* and the column of sensors S1*d*, S2*e*, and S3*f* is shorter than the width of each bill. The two sensors S1*a* and Sid are aligned across the sensor S1 in a direction perpendicular to the deposit/withdrawal directions (that is, in a horizontal direction). Similarly the two sensors S2*b* and S2*e* are aligned across the sensor S2 in the horizontal direction. The two sensors S3*c* and S3*f* are aligned across the sensor S3 in the horizontal direction.

In this configuration of the first application in. Modified Example 2, the cash receiving process may determine completion of deposit of bills by taking into account the inclination of the inserted bills, based on the outputs of the three sensors S3, S3*c*, and S3*f* at step S135 (FIG. 15). For example, in the case where a bundle of bills is not inclined but is held in an ordinary attitude like a bundle of bills C6 shown in FIG. 21A, the light is shielded in the two sensors S3*c* and S3*f*, as well as the sensor S3. In the case where a bundle of bills is inclined and is held in an extraordinary attitude like a bundle of bills C7 shown in FIG. 21A, the light is not shielded in the sensor S3*c*, while the light is shielded in the sensor S3. The procedure may thus determine completed deposit of bills when the light is shielded in all the three sensors S3, S3*c*, and 53*f*, while determining uncompleted deposit of bills when the light is not shielded in any of these sensors.

In one modification, completed deposit of bills may be determined when the light is not shielded in any of the three sensors S1, S1*a*, and S1*d* (or S2, S2*b*, and S2*e*), while uncompleted deposit of bills may be determined when the light is shielded in any of these sensors. Such modification is not restricted to step S135 but may also be applied to the cash delivery process of the third embodiment shown in FIGS. 17 and 18. A modified procedure may specify the inclination of the bills after determination that the bundle of bills has an ordinary thickness at step S405 and perform the processing of and after step S460 on determination of inclination of the bills (extraordinary attitude of the bills).

Figure 21B:
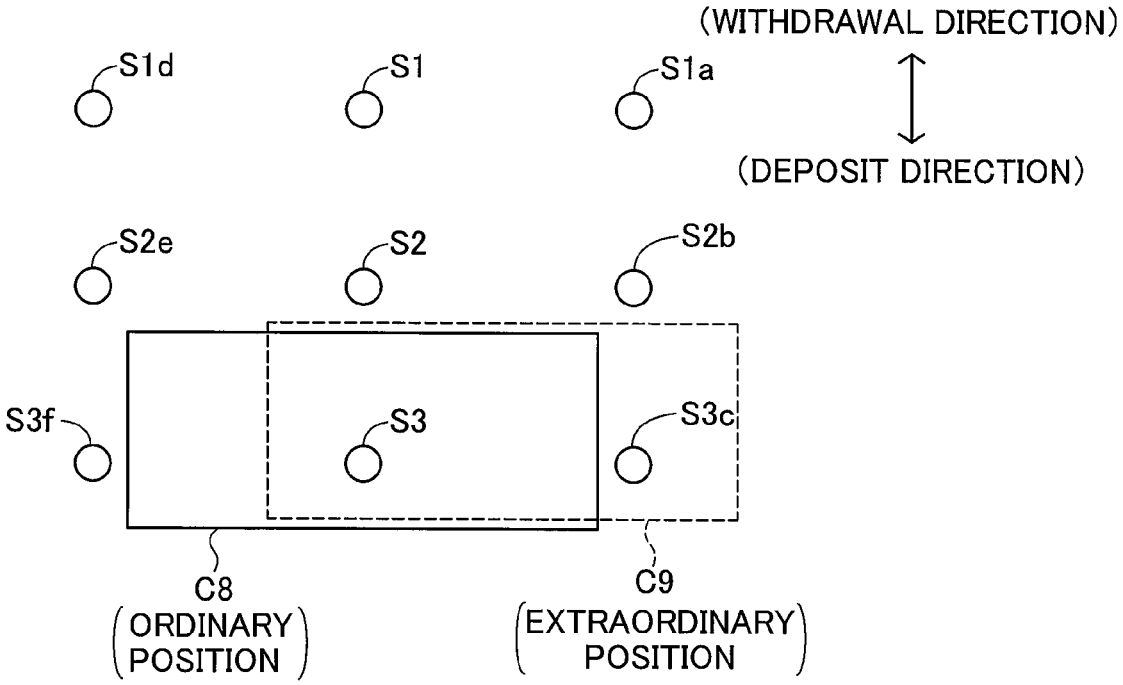

FIG. 21B is an explanatory diagram schematically showing a sensor arrangement in an automated teller machine of a second application in Modified Example 2. Unlike the automated teller machine of the first application in Modified Example 2 shown in FIG. 21A, in the automated teller machine of the second application in Modified Example 2, the distance between the column of sensors S1*a*, S2*b*, and S3*c* and the column of sensors Sid, Step, and S3*f* is longer than the width of each bill.

In this configuration of the second application in Modified Example 2, the cash receiving process may determine completion of deposit of bills by taking into account a positional misalignment of the inserted bills in the width direction, based on the outputs of the three sensors S3, S3*c*, and S3*f* at step S135 (FIG. 15). For example, in the case where a bundle of bills is held at an ordinary position like a bundle of bills C8 shown in FIG. 21B, the light is shielded in the only one sensor S3 among the three sensors S3, S3*c*, and S3*f*. In the case where a bundle of bills is held with a positional misalignment from the ordinary position in the width direction of bills like a bundle of bills C9 shown in FIG. 21B, the light is shielded in the sensor S3*c*, as well as in the sensor S3. The procedure may thus determine completed deposit of bills when the light is shielded only in the sensor S3, while determining uncompleted deposit of bills when the light is shielded in either the sensor S3*c* or in the sensor S3*f*.

In general, the paper sheet handling machine of the present invention may be equipped with the detection unit configured to detect the conveyance-related information as arbitrary information regarding the state of paper sheets during conveyance.

D3. Modified Example 3

The cash receiving process of the first embodiment shown in the flowchart of FIG. 7 drives the clamp belts in the pair of clamping mechanisms 402 and 403 (step S130), in response to detection of insertion of any bill (step S125: yes). One modified procedure of the cash receiving process may wait for a predetermined time period after detection of insertion of any bill and subsequently drive the clamp belts in the pair of clamping mechanisms 402 and 403. For example, the procedure may drive the clamp belts after elapse of one second since detection of insertion of any bill. This arrangement enables the bundle of bills to be securely hit against the clamp belts and adjusts the inclination of the bundle of bills before driving the clamp belts. This arrangement effectively prevents the occurrence of a bill jam due to inclination of the bills during conveyance of the bills by means of the clamp belts.

D4. Modified Example 4

In the configuration of the second embodiment discussed above, the rear clamping mechanism 402 is set at the retreat position, prior to insertion of bills. In one modification, the rear clamping mechanism 402 may be set at a position overlapping with the rear push plate 202. In the configuration of the second embodiment, the front clamping mechanism 403 is set at the deposit position, prior to insertion of bills (step S110*a* in FIG. 12). In one modification, the front clamping mechanism 403 may be set at the retreat position, like the rear clamping mechanism 402. In this modified configuration, bills are not automatically drawn in at the time of insertion of the bills, but the inserted bills are hit against the stopper 214. The user is thus not required to insert the hand or fingers into the bill accumulation area Ra.

One preferable application enables the operation mode of the automated teller machine to be changed over between the work mode in any of the embodiments discussed above and a rest mode or conventional mode where the pair of clamping mechanisms 402 and 403 are set at the retreat positions and the stopper 214 is set at the retreat position at the time of insertion of bills. In this application, multiple different control programs may be stored in the memory 312 to enable the CPU 320 to have the functions of the deposit/withdrawal controller corresponding to the respective modes. A maintenance personnel may operate a maintenance terminal or another equipment to change over the operation mode. In some nations and countries where automated teller machines are not popular and many users may be afraid of inserting their hands or fingers inside the machine, the work mode of the first embodiment or the third embodiment may be set to the work mode. In other nations and countries where automated teller machines are popular and few users may be afraid of inserting their hands or fingers inside the machine, the conventional mode may be set to the work mode. Namely the automated teller machine of the invention is applicable in any countries and nations.

D5. Modified Example 5

In the configurations of the first and the third embodiments discussed above, the pair of clamping mechanisms 402 and 403 are in contact with each other at the time of insertion of bills. In one modification, the pair of clamping mechanisms 402 and 403 may be arranged to be apart from each other across a small distance. The pair of clamping mechanisms 402 and 403 may be arranged in a V shape like the first and the third embodiments with their respective ends apart from each other by a small distance (for example, about 5 millimeters). In this modified configuration, there is a relatively wide space between the pair of clamping mechanisms 402 and 403 at the position closer to the cash slot 21. This modified arrangement still assures the user of the easy insertion and deposit of bills and gives the user the bill-bumping feeling in the case of insertion of a lot of bills. In this modified configuration, the clamping mechanisms 402 and 403 (specifically the pulleys on the lower-most ends) may be fixed to prohibit the pivotal rotations.

In another modification, the pair of clamping mechanisms 402 and 403 may be arranged to be in parallel with each other across a small distance. In this modified configuration, the pair of clamping mechanisms 402 and 403 may be designed to be movable (pivotally rotatable) according to the thickness of the inserted bundle of bills. This gives the user the bill draw-in feeling.

D6. Modified Example 6

In the configurations of the respective embodiments described above, the two clamp belts in the front clamping mechanism 403 and the two clamp belts in the rear clamping mechanism 402 are arranged to hold the central part of the bills in the width direction. In one modification, the clamp belts in the pair of clamping mechanisms 402 and 403 may be arranged to hold both end parts of the bills in the width direction. In the embodiments discussed above, the clamp belts are used as the structure of clamping and conveying bills in the two clamping mechanisms 402 and 403. Lines of multiple pulleys may be used instead of the clamp belts.

D7. Modified Example 7

In the configurations of the respective embodiments described above, the actuator A4 for generating the driving force of the clamp belts 411 and 412 in the rear clamping mechanism 402 is constructed independently of the rear clamping mechanism 402 and is accordingly not moved with the rear clamping mechanism 402. The technique of the present invention is, however, not restricted to this arrangement. In one modification, the actuator A4 may be constructed as a part of the rear clamping mechanism 402, for example, to be attached to the guide plate 415, and may be moved with the rear clamping mechanism 402.

D8. Modified Example 8

In the configurations of the respective embodiments described above, the cash deposit/withdrawal mechanism 20 is inclined relative to the direction of gravity (relative to the vertical direction). Alternatively the cash deposit/withdrawal mechanism 20 may be arranged along the direction of gravity (along the vertical direction). This arrangement adjusts the lower ends of the bills when the inserted bills are bumped into the bottom plate 208 or the stopper 214, thus facilitating correction of the inclined attitude of the bills.

D9. Modified Example 9

The cash delivery process of the third embodiment determines whether the bundle of bills has an ordinary thickness or an extraordinary thickness, based on the moving distance of the front clamping mechanism 403. Another arbitrary factor may be used as the criterion of such determination. One modified procedure may measure a moving time of the pair of clamping mechanisms 402 and 403 and determine that the bundle of bills has an extraordinary thickness when the moving time is shorter than a preset threshold time. Another modified procedure may use an ultrasonic sensor or a similar instrument to directly measure the thickness of the bundle of bills and determine as ordinary or extraordinary.

D10. Modified Example 10

Each of the embodiments describes the automated teller machine as one application of the paper sheet handling machine in accordance with the present invention. The principle of the present invention is not restricted to the automated teller machine but is also applicable to any paper sheet handling machine for handling any paper sheets, such as checks, postcards, or commuter tickets.

D11. Modified Example 11

In the respective embodiments described above, part of the hardware configuration may be replaced by software configuration, while part of the software configuration may be replaced by hardware configuration.

E. Other Aspects

According to another aspect, the invention is also directed to a paper sheet handling machine, which includes; a paper sheet slot configured to receive and provide a paper sheet; and a pair of conveyor assemblies including a first conveyor assembly and a second conveyor assembly configured to hold and convey the paper sheet inserted and discharged via the paper sheet slot. In a state where the paper sheet is not inserted or discharged via the paper sheet slot, the first conveyor assembly and the second conveyor assembly are arranged, such that a distance between the first conveyor assembly and the second conveyor assembly decreases with a distance away from the paper sheet slot.

In the paper sheet handling machine of this aspect, in the state of no insertion or no delivery of the paper sheet, the first conveyor assembly and the second conveyor assembly are arranged, such that the distance between the pair of conveyor assemblies is shortened with the distance away from the paper sheet slot. This gives the user the paper sheet bumping feeling at the time of insertion of the paper sheet and thus allows the user to release the paper sheet from the hand or fingers with a sense of security. In an area closer to the paper sheet slot, there is a relatively long distance between the first conveyor assembly and the second conveyor assembly. This arrangement facilitates the user's insertion of the paper sheet into the paper sheet handling machine, while preventing the occurrence of a paper sheet jam during conveyance.

In one preferable application of the paper sheet handling machine according to the above aspect of the invention, the first conveyor assembly and the second conveyor assembly are brought into contact with each other at a position farther most away from the paper sheet slot.

The paper sheet handling machine of this application enables the inserted paper sheet to be securely hit against the pair of conveyor assemblies and thereby effectively eliminates the inclination of the paper sheet.

In another preferable application of the paper sheet handling machine according to the above aspect of the invention, at least one of the first conveyor assembly and the second conveyor assembly is pivotally rotatable in a direction of thickness of the paper sheet inserted and discharged via the paper sheet slot.

In the paper sheet handling machine of this application, the distance between the first conveyor assembly and the second conveyor assembly is increased or decreased according to the thickness of the paper sheet. This arrangement securely holds and collectively conveys an inserted bundle of paper sheets.

In still another preferable application of the paper sheet handling machine according to the above aspect of the invention, each of the first conveyor assembly and the second conveyor assembly has multiple belts arranged in parallel with a direction of conveyance of the paper sheet.

In the paper sheet handling machine of this application, the paper sheet is conveyed while being supported by the multiple belts. This arrangement desirably prevents the paper sheet from being folded or bent in the course of conveyance.

In one preferable embodiment of the invention, the paper sheet handling machine of the above aspect further comprises: a pair of push plates configured to hold the paper sheet inserted into and discharged from the paper sheet handling machine via the paper sheet slot and apply a pressing force to the paper sheet in a thickness direction thereof; a moving mechanism configured to move the first conveyor assembly and the second conveyor assembly in mutually approaching directions or in mutually away directions and locate the first conveyor assembly and the second conveyor assembly at any position between inside and outside the pair of push plates, seen from the paper sheet slot; a first sensor configured to detect insertion of the paper sheet into the paper sheet slot; and a second sensor configured to detect arrangement of the paper sheet at a holdable position to be held by the pair of push plates.

The moving mechanism moves the first conveyor assembly and the second conveyor assembly to be located inside the pair of push plates, seen from the paper sheet slot, prior to insertion of the paper sheet into the paper sheet slot. When the first sensor detects the insertion of the paper sheet into the paper sheet slot, the first conveyor assembly and the second conveyor assembly hold the paper sheet and convey the paper sheet in a receiving direction to be taken into the paper sheet handling machine. When the second sensor detects the arrangement of the paper sheet at the holdable position to be held by the pair of push plates, the moving mechanism moves the first conveyor assembly and the second conveyor assembly to be located outside the pair of push plates, seen from the paper sheet slot.

The structure of this embodiment causes the inserted paper sheet to be securely held by the pair of conveyor assemblies and conveyed into the paper sheet handling machine. This gives the user the paper sheet draw-in feeling and enables the user to readily insert the paper sheet into the paper sheet handling machine without inserting the hand or fingers. When the paper sheet is arranged at the holdable position to be held by the pair of push plates, the pair of conveyor assemblies are moved to be located outside the pair of push plates. This arrangement causes the paper sheet to be not in contact with the pair of conveyor assemblies, thus effectively preventing the paper sheet from being bent or folded.

According to still another aspect, the invention is further directed to a method of receiving a paper sheet in a paper sheet handling machine. The paper sheet handling machine includes: a paper sheet slot configured to receive and deliver a paper sheet; a pair of push plates configured to hold the paper sheet inserted into and discharged from the paper sheet handling machine via the paper sheet slot and apply a pressing force to the paper sheet in a thickness direction thereof; a pair of conveyor assemblies including a first conveyor assembly and a second conveyor assembly configured to hold and convey the paper sheet inserted and discharged via the paper sheet slot; a first sensor configured to detect insertion of the paper sheet into the paper sheet slot; and a second sensor configured to detect arrangement of the paper sheet at a holdable position to be held by the pair of push plates.

The method moves the first conveyor assembly and the second conveyor assembly in mutually approaching directions, so as to arrange the first conveyor assembly and the second conveyor assembly inside the pair of push plates, seen from the paper sheet slot, such that a distance between the first conveyor assembly and the second conveyor assembly decreases with a distance away from the paper sheet slot.

When the first sensor detects the insertion of the paper sheet into the paper sheet slot, the paper sheet receiving method causes the first conveyor assembly and the second conveyor assembly to hold the paper sheet and take in the paper sheet in a receiving direction to be taken into the paper sheet handling machine.

When the second sensor detects the arrangement of the paper sheet at the holdable position to be held by the pair of push plates, the paper sheet receiving method moves the first conveyor assembly and the second conveyor assembly to be located outside the pair of push plates, seen from the paper sheet slot.

Prior to insertion of the paper sheet into the paper sheet slot, the method of receiving a paper sheet according to this aspect of the invention arranges the first conveyor assembly and the second conveyor assembly, such that the distance between the pair of conveyor assemblies is shortened with the distance away from the paper sheet slot. This gives the user the paper sheet bumping feeling at the time of insertion of the paper sheet and thus allows the user to release the paper sheet from the hand or fingers with a sense of security. In an area closer to the paper sheet slot, there is a relatively long distance between the first conveyor assembly and the second conveyor assembly. This arrangement facilitates the user's insertion of the paper sheet into the paper sheet handling machine. The paper sheet receiving method causes the inserted paper sheet to be securely held by the pair of conveyor assemblies and conveyed into the paper sheet handling machine. This gives the user the paper sheet draw-in feeling and enables the user to readily insert the paper sheet into the paper sheet handling machine without inserting the hand or fingers. When the paper sheet is arranged at the holdable position to be held by the pair of push plates, the pair of conveyor assemblies are moved to be located outside the pair of push plates. This method causes the paper sheet to be not in contact with the pair of conveyor assemblies, thus effectively preventing the paper sheet from being bent or folded.

According to another aspect, the invention is directed to a paper sheet handling machine, which comprises: a paper sheet slot configured to receive and provide a paper sheet; a pair of conveyor assemblies including a first conveyor assembly and a second conveyor assembly mutually approaching to hold and convey the paper sheet inserted and discharged via the paper sheet slot; a moving mechanism configured to move the first conveyor assembly and the second conveyor assembly in mutually approaching directions or in mutually away directions; a detection unit configured to detect information on a state of the paper sheet during conveyance as conveyance-related information with regard to the paper sheet held by the pair of conveyor assemblies; and a determination module configured to determine whether conveyance of the paper sheet is possible or impossible, based on the conveyance-related information. Upon determination of the possible conveyance by the determination module, the moving mechanism moves the first conveyor assembly and the second conveyor assembly in the mutually approaching direction to hold the paper sheet. Upon determination of the impossible conveyance by the determination module, the moving mechanism moves the first conveyor assembly and the second conveyor assembly in the mutually away direction to release the paper sheet.

In the paper sheet handling machine according to this aspect of the invention, the paper sheet inserted and discharged via the paper sheet slot is held and conveyed by means of the first conveyor assembly and the second conveyor assembly. This arrangement enables the user to readily insert and take out the paper sheet into and from the paper sheet handling machine without inserting the hand or fingers. Upon determination of the possible conveyance, the paper sheet is held and conveyed by the first conveyor assembly and the second conveyor assembly. Upon determination of the impossible conveyance, on the other hand, the paper sheet is released from the pair of conveyor assemblies. Namely the paper sheet handling machine of the invention does not allow the paper sheet to be held and conveyed by the pair of conveyor assemblies, in the case of impossible conveyance. This arrangement effectively protects the first conveyor assembly and the second conveyor assembly from potential damages, while preventing any fold or bent of the paper sheet, thus preventing the occurrence of any paper sheet jam during conveyance.

In one preferable application of the paper sheet handling machine according to the above aspect of the invention, the conveyance-related information includes at least one of a thickness of the paper sheet, an inclination of the paper sheet, and the presence or the absence of the remaining paper sheet.

The paper sheet handling machine of this application does not allow a bundle of paper sheets, which has an extremely large thickness and is not securely holdable by the pair of conveyor assemblies, to be conveyed by the pair of conveyor assemblies. The paper sheet handling machine of this application also prohibits the conveyance of the paper sheet in an inclined orientation. The paper sheet handling machine of this application further prohibits the further conveyance of paper sheets by the pair of conveyor assemblies in the presence of any remaining paper sheet.

In one preferable embodiment of the invention, the paper sheet handling machine of the above aspect further comprises a moving distance measurement unit configured to measure a moving distance of at least one of the first conveyor assembly and the second conveyor assembly. The conveyance-related information includes at least a thickness of the paper sheet. The detection unit detects the thickness of the paper sheet, based on the moving distance measured by the moving distance measurement unit.

The paper sheet handling machine of this embodiment readily detects the thickness of the paper sheet.

In one preferable embodiment of the invention, the paper sheet handling machine of the above aspect further comprises: a bottom face arranged opposite to the paper sheet slot. The detection unit includes multiple sensors arranged along a conveyance direction between the paper sheet slot and the bottom face to detect passage of the paper sheet. At the time of delivery of the paper sheet from the paper sheet slot, the moving mechanism moves the first conveyor assembly and the second conveyor assembly in the mutually approaching directions to hold the paper sheet. At the time of delivery of the paper sheet from the paper sheet slot, the pair of conveyor assemblies are driven by a specific amount to convey the held paper sheet by a preset distance that is shorter than a distance between the paper sheet slot and the bottom face. At the time of delivery of the paper sheet from the paper sheet slot, when an outer sensor located on a side closer to the paper sheet slot among the multiple sensors does not detect passage of the paper sheet, the determination module determines that the conveyance of the paper sheet is impossible. When the outer sensor detects passage of the paper sheet, the determination module determines that the conveyance of the paper sheet is possible.

This arrangement accurately determines the cases of impossible conveyance of the paper sheet, for example, the case where the paper sheet to be delivered has an extremely large thickness or the case where the paper sheet is stuck somewhere in the paper sheet handling machine.

In another preferable embodiment of the invention, the paper sheet handling machine of the above aspect further comprises: a bottom face arranged opposite to the paper sheet slot. The detection unit includes multiple sensors arranged along a conveyance direction between the paper sheet slot and the bottom face to detect passage of the paper sheet. At the time of conveyance of the paper sheet inserted via the paper sheet slot, the moving mechanism moves the first conveyor assembly and the second conveyor assembly in the mutually approaching directions to hold the paper sheet. At the time of conveyance of the paper sheet inserted via the paper sheet slot, the pair of conveyor assemblies are driven by a specific amount to convey the held paper sheet by a preset distance that is shorter than a distance between the paper sheet slot and the bottom face. At the time of conveyance of the paper sheet inserted via the paper sheet slot, when an inner sensor located on a side closer to the bottom face among the multiple sensors does not detect passage of the paper sheet, the determination module determines that the conveyance of the paper sheet is impossible. When the inner sensor detects passage of the paper sheet, the determination module determines that the conveyance of the paper sheet is possible.

This arrangement accurately determines the cases of impossible conveyance of the paper sheet, for example, the case where the inserted paper sheet has an extremely large thickness or the case where the paper sheet is stuck somewhere in the paper sheet handling machine.

What is claimed is:

1. A paper sheet handling machine, comprising:

a paper sheet slot configured to receive and provide a paper sheet;

a pair of push plates configured to hold the paper sheet inserted into and discharged from the paper sheet handling machine via the paper sheet slot and apply a pressing force to the paper sheet in a thickness direction thereof;

a pair of conveyor assemblies, including a first conveyor assembly and a second conveyor assembly, configured to hold and convey the paper sheet inserted and discharged via the paper sheet slot;

a moving mechanism configured to move the first conveyor assembly and the second conveyor assembly in mutually approaching directions or in mutually away directions, so as to locate the pair of conveyor assemblies, including the first conveyor assembly and the second conveyor assembly, to be, as seen from the paper sheet slot, at any of: (a) a position in between the pair of push plates, (b) a position outside of the pair of push plates, or (c) a position overlapping the pair of push plates, wherein prior to discharge of the paper sheet from the paper sheet slot, the moving mechanism is configured to move the first conveyor assembly and the second conveyor assembly to outside of the pair of push plates; and a sensor configured to detect arrangement of the paper sheet at a position holdable by the pair of conveyor assemblies;

wherein when the sensor detects the arrangement of the paper sheet at the position holdable by the pair of conveyor assemblies, the moving mechanism moves the first conveyor assembly and the second conveyor assembly to inside the pair of push plates, as seen from the paper sheet slot; and wherein when the sensor detects the arrangement of the paper sheet at the position holdable by the pair of conveyor assemblies, the first conveyor assembly and the second conveyor assembly hold the paper sheet and convey the paper sheet in a delivery direction toward the paper sheet slot.

2. The paper sheet handling machine in accordance with claim 1, wherein the pair of push plates and the pair of conveyor assemblies are arranged to be overlapped with each other in a specific state where a distance between the pair of push plates is identical with a distance between the pair of conveyor assemblies.

3. The paper sheet handling machine in accordance with claim 1, wherein the pair of conveyor assemblies are configured to hold a central part of the paper sheet in a width direction thereof.

4. The paper sheet handling machine in accordance with claims claim 1, wherein at least either of the pair of conveyor assemblies and the pair of push plates hold the paper sheet to be arranged along a vertical direction.

5. The paper sheet handling machine in accordance with claim 1, the paper sheet handling machine further comprising:

a second sensor configured to detect insertion of the paper sheet into the paper sheet slot; and a third sensor configured to detect arrangement of the paper sheet at a position holdable by the pair of push plates, wherein the moving mechanism moves the first conveyor assembly and the second conveyor assembly to be located inside the pair of push plates, as seen from the paper sheet slot, prior to insertion of the paper sheet into the paper sheet slot, wherein when the second sensor detects the insertion of the paper sheet into the paper sheet slot, the first conveyor assembly and the second conveyor assembly hold the paper sheet and convey the paper sheet in a receiving direction to be taken into the paper sheet handling machine, and wherein when the third sensor detects the arrangement of the paper sheet at the position holdable by the pair of push plates, the moving mechanism moves the first conveyor assembly and the second conveyor assembly to be located outside of the pair of push plates, as seen from the paper sheet slot.

6. The paper sheet handling machine in accordance with claim 1, wherein each of the first conveyor assembly and the second conveyor assembly has multiple belts arranged in parallel with a direction of conveyance of the paper sheet.

7. The paper sheet handling machine in accordance with claim 1, the paper sheet handling machine further comprising:

a driving source configured to generate a conveyance driving force of the paper sheet to be used by the first conveyor assembly;

a frame configured to support the first conveyor assembly to be movable in either a direction approaching to the second conveyor assembly or a direction away from the second conveyor assembly; and a transmission structure coupled with the first conveyor assembly to move with a motion of the first conveyor assembly and transmit the conveyance driving force generated by the driving source to the first conveyor assembly.

8. The paper sheet handling machine in accordance with claim 1, wherein the moving mechanism is configured to move the first conveyor assembly and the second conveyor assembly in mutually approaching directions, so as to locate the first conveyor assembly and the second conveyor assembly, to be, as seen from the paper sheet slot, at: (a) a position in between the pair of push plates.

9. The paper sheet handling machine in accordance with claim 1, wherein the moving mechanism is configured to move the first conveyor assembly and the second conveyor assembly in mutually away directions, so as to locate the first conveyor assembly and the second conveyor assembly, to be, as seen from the paper sheet slot, at: (b) a position outside of the pair of push plates.

10. The paper sheet handling machine in accordance with claim 9, wherein prior to discharge of the paper sheet from the paper sheet slot, the moving mechanism moves the first conveyor assembly and the second conveyor assembly to outside of the pair of push plates.

11. The paper sheet handling machine in accordance with claim 1, wherein the moving mechanism is configured to move the first conveyor assembly and the second conveyor assembly in mutually approaching directions or in mutually away directions, so as to locate the first conveyor assembly and the second conveyor assembly, to be, as seen from the paper sheet slot, at: (c) at a position overlapping the pair of push plates.

* * * * *